US006824123B2

(12) United States Patent
Larsen et al.

(10) Patent No.: US 6,824,123 B2
(45) Date of Patent: Nov. 30, 2004

(54) PICKET FENCE AND RAIL MOUNTING SYSTEM

(75) Inventors: Charles Larsen, Huntington Beach, CA (US); Michael Lindsey, Ontario, CA (US)

(73) Assignee: Master-Halco, Inc., La Habra, CA (US)

( * ) Notice: Subject to any disclaimer, the term of this patent is extended or adjusted under 35 U.S.C. 154(b) by 29 days.

(21) Appl. No.: 09/865,125

(22) Filed: May 24, 2001

(65) Prior Publication Data

US 2002/0175321 A1 Nov. 28, 2002

(51) Int. Cl.[7] ..... E04H 17/00

(52) U.S. Cl. ..... 256/65.01; 256/22; 256/59; 256/21; 256/65.12

(58) Field of Search ..... 256/1, 22, 59, 256/64, 65.01, 65.02, 65.11, 65.12, 21, 65.15; 403/263

(56) References Cited

U.S. PATENT DOCUMENTS

| | | | |
|---|---|---|---|
| 262,448 | A | 8/1882 | Maunder |
| 626,733 | A | 6/1899 | Stewart Jr. et al. |
| 791,327 | A | 5/1905 | Dale |
| 1,109,613 | A | 9/1914 | Canada |
| 1,376,150 | A | 4/1921 | Miller |
| 1,963,981 | A | 6/1934 | Garrett |
| 2,218,953 | A | 10/1940 | Gustafson |
| 2,590,929 | A | 4/1952 | Bush |
| 3,724,865 | A | 4/1973 | Cristie |
| 3,724,884 | A | 4/1973 | Roider |
| 3,849,008 | A | 11/1974 | Boucher et al. |

(List continued on next page.)

OTHER PUBLICATIONS

02825/BOU, Buyline 0211, Boundary Fence & Railing Systems, Inc., 1996, pp 2, 8.
Master Halco, Classic Ornamental Premier, 1997.
Monumental Iron Works, 1997, Architectural 7.
Monumental Iron Works, 1994, Architectural 6.

*Primary Examiner*—Gregory J. Binda
*Assistant Examiner*—Victor MacArthur
(74) *Attorney, Agent, or Firm*—Knobbe, Martens, Olson & Bear, LLP

(57) ABSTRACT

A picket fence and rail mounting system that is easily transformable by the consumer into a variety of aesthetic styles is provided. The system comprises at least an upper and a lower elongate rail. Each rail has a hollow interior defining a substantially I-shaped cross-section including at least a first slot and a second slot. A plurality of pickets are transversely slidable through openings in an upper surface of the rails and a channel in a lower surface. The pickets each have at least a first notch or indentation near a first end and a second notch or indentation near a second end. The distance from the first end to the first notch or indentation is preferably shorter than the distance from the second end to the second notch or indentation. An elongate retaining rod slidable within at least one rail cooperates with a notch or indentation on each picket to secure the picket to the rail. Rather than the retaining rod, spring clips, threaded fasteners or the like may cooperate with a hole in each picket to secure the picket to the rail. The pickets are invertible, such that they extend a distance x or a distance y above the upper rail depending upon whether the first or second notch or indentation or hole engages the retaining rod or other fastening member. Finials and decorative inserts may be secured to the fence to provide more aesthetic styles. Further, the upper rail is invertible, wherein a smooth cap may be secured to the upwardly facing surface of the upper rail, providing the fence with a smooth upper end having no protruding pickets.

37 Claims, 23 Drawing Sheets

U.S. PATENT DOCUMENTS

| | | | | | |
|---|---|---|---|---|---|
| 4,435,103 | A | | 3/1984 | Becker et al. | |
| 4,474,299 | A | | 10/1984 | Andrews | |
| 4,667,935 | A | | 5/1987 | Moore | |
| 4,723,760 | A | | 2/1988 | O'Sullivan | |
| 4,883,256 | A | | 11/1989 | Hebda | |
| 4,986,513 | A | | 1/1991 | Schultz et al. | |
| 5,150,885 | A | | 9/1992 | Leone | |
| 5,192,054 | A | | 3/1993 | Sharp | |
| 5,443,244 | A | | 8/1995 | Gibbs | |
| 5,454,548 | A | | 10/1995 | Moore | |
| 5,547,169 | A | | 8/1996 | Russell | |
| 5,557,893 | A | * | 9/1996 | Bowls | 256/64 |
| 5,581,868 | A | | 12/1996 | Bisch | |

* cited by examiner

PICKET FENCE AND RAIL MOUNTING SYSTEM

BACKGROUND OF THE INVENTION

1. Field of the Invention

The present invention relates to metal picket fences that are packaged and sold as a collection of pre-fabricated parts for assembly by the consumer. More specifically, the present invention provides an improved fence that offers a variety of aesthetic styles in one convenient package, and is adaptable to placement on sloped, as well as flat, terrain.

2. Description of the Related Art

Metal picket fences are well known. They consist of a number of vertical members, called "pickets," secured to at least two horizontal supports to form a panel. A number of these panels are then secured together with posts that are anchored in the ground or other suitable mounting surface. Picket fences are typically used as protective barriers around private properties, swimming pools, gardens and the like, and may include decorative features. One type that has been popular for many years is constructed of wrought iron components that are welded together. This type of fence is typically constructed and installed by a skilled artisan. For this reason, they are usually quite expensive.

More recently, a less costly type of picket fence has emerged. This type of picket fence is constructed of a collection of pre-fabricated components that are packaged and sold through retail outlets. The components are designed to be easily put together by the average "do-it-yourself" type of consumer. Like the welded variety, this type of fence also serves as an effective barrier to unwanted guests and may also be aesthetically pleasing.

U.S. Pat. No. 2,218,953 to Gustafson discloses an adjustable grade iron fence. The fence comprises vertical pickets of channel shaped or square cross-section held in position and in spaced relation by horizontal upper and lower rails. Each picket includes two horizontal slots across one vertical face, the position of each slot corresponding to the positions of the upper and lower rails. The upper and lower rails are identical, each including space to accommodate a locking member that is driven between the side walls of the rails and the slots on the pickets. Because the bottom surface of each rail comprises an open channel, and the slots in the pickets are larger than the locking member, the pickets remain parallel to one another while the rails are translated along their longitudinal axes in opposite directions. This feature enables the fence to be installed on sloped ground, because the posts and pickets remain vertical even when the rails are slanted from the horizontal.

U.S. Pat. No. 5,454,548 to Moore discloses a picket fence that is very similar to the Gustafson structure. The Moore structure includes tubular pickets of square cross-section having a pair of horizontal slots along one face, upper and lower horizontal rails that hold the pickets in spaced relation, and a coupling bar that nests between the rail side wall and the picket slots to lock the pickets in place.

Another patent to Moore, U.S. Pat. No. 4,667,935, discloses a structure similar to the '548 patent. The pickets and rails of the '935 patent, however, are secured to one another with screws instead of a coupling bar. Also, decorative caps may optionally be installed over the upper ends of the pickets.

U.S. Pat. No. 5,443,244, to Gibbs discloses a rolled metal fence rail incorporated into a picket fence that includes two or more such rails. Each rail is formed from a single metal sheet rolled to enclose an upside down and generally U-shaped channel. A space between the top and bottom walls of the rails forms a relatively narrow raceway to restrict vertical movement of the pickets when they are mounted on the retaining rods. The rails generally have openings in a top wall that are slightly larger than the cross-section of the picket passing therethrough, and an opening in a bottom wall whose transverse dimension is substantially equal to that of the picket passing therethrough, but whose longitudinal dimension exceeds that of the picket.

U.S. Pat. No. 4,883,256, to Hebda discloses a picket fence arrangement having tubular pickets of triangular cross-section. Three notches are cut at two different lengthwise positions along each picket, one notch being located at each corner of the triangular cross-section. The rails have spaced triangular openings adapted to slidably receive the pickets. With the notches on a picket positioned at the rail openings, the picket is rotatable so that the notches engage the straight edges of the triangular openings in the rail and prevent relative translation of the picket and rail. A locking rod inserted within each rail cooperates with a bore in each picket to prevent the pickets from rotating.

U.S. Pat. No. 1,376,150, to Miller discloses a joint lock for use in connecting bars to rails. The rails of the '150 patent are of a two-piece construction, having an outer tubular member provided with a slot on one side and perforations on another side. The perforations are adapted to receive vertical bars, each end of which is provided with a head formed by providing a pair of transverse grooves in opposite sides of the bar. The bars are secured to the outer tubular member by an inner tubular member, or locking member, which is slidably insertable within the outer tubular member. The locking member includes two spaced slots adapted to engage the grooves in the bar and lockingly engage the bars to hold them within the outer tubular member.

A drawback to these prior art designs is that each fence only offers one outward appearance. The Gustafson patent, for example, discloses pickets that have pointed top ends, while the pickets disclosed in the Moore patent have flat top ends. And, in each of these designs, all pickets extend a uniform distance above the top rail. Further, these fences, and every other fence in the prior art, may only be set up one way, so that a consumer who wants his fence to look one particular way has to search until he finds that fence. No prior art suggests a single pre-packaged fence that may be set up in a variety of ways to adopt a variety of appearances.

SUMMARY OF THE INVENTION

The picket fence of this invention has several features, no single one of which is solely responsible for its desirable attributes. Without limiting the scope of this invention as expressed by the claims that follow, its more prominent features will now be discussed briefly. After considering this discussion, and particularly after reading the section entitled "Detailed Description of the Drawings," one will understand how the features of this invention provide advantages, which include the capability to be set up in a variety of ways to display a variety of aesthetic styles, ease of manufacture and assembly, low cost, and adaptability to terrain of varying slope.

The picket fence is constructed of a number of substantially vertical pickets that are secured by upper and lower rails. The pickets are preferably constructed of hollow tubes having a substantially square cross-section. In one preferred embodiment, each picket includes at least two spaced notches or indentations. The notches or indentations may be in the same picket face or in oppositely facing picket faces. The notches are preferably located on the picket such that the distance from a first end of the picket to the first notch is greater than the distance from a second end of the picket to the second notch. Preferably, each side of the notches is V-shaped, so that the center portion of the notch is narrowest, with the notch becoming gradually wider toward either edge.

In another preferred embodiment, the notches are replaced by through-holes. Again, the holes may be in the same face, or in opposite faces. In another preferred embodiment, a first pair of holes in oppositely facing picket faces is located at a first position along the length of the picket, and a second pair of holes in the same picket faces is located at a second position along the length of the picket. The spacing of the hole positions is preferably as described above with respect to the notches or indentations.

The rails preferably have a hollow interior defining a substantially I-shaped cross-section including a pair of oppositely disposed upper slots and a pair of oppositely disposed lower slots. The exterior of the rails may or may not mimic the I-shaped cross-section of the interior. An upper surface of the rail contains spaced openings having a shape similar to the cross-section of the pickets, but of slightly larger dimensions. A lower surface of the rail contains a channel running in a longitudinal direction along the rail, and having a width at least as wide as the width of each opening.

In one preferred embodiment, a first retaining rod is slidable within the upper rail to cooperate with the upper notch or indentation in each picket to secure the pickets to the upper rail. A second retaining rod is similarly slidable within the lower rail to cooperate with the lower notch or indentation in each picket to secure the pickets to the lower rail. The rod may have one of a wide range of cross-sections including circular, oval, square and L-shaped, depending upon the shape and size of the picket notch or indentation.

In another preferred embodiment, the pickets are secured to the rails with spring clips. A pin on either side of the spring clip protrudes through the holes on opposite sides of the picket and projects into the rail channel to prevent vertical movement of the picket. In another preferred embodiment, screws, bolts, rivets or other suitable members are driven through the side of the rail channel to cooperate with the holes in the picket and secure the picket to the rail.

Because the rails are invertible, and because the picket notches are not evenly spaced from their respective ends, the fence is easily convertible by the consumer into a variety of aesthetic styles. In one configuration, the upper and lower rails are oriented channel-side-down, and a first end of each picket points upward, such that each picket protrudes a distance x from the upper surface of the upper rail, and each picket also protrudes a distance y from the lower surface of the lower rail, wherein y>x.

In another configuration, the upper and lower rails are oriented channel-side-down, and a second end of each picket points upward, such that each picket protrudes a distance y from the upper surface of the upper rail, and each picket also protrudes a distance x from the lower surface of the lower rail, wherein y>x.

In another configuration, the upper and lower rails are oriented channel-side-down, and a first end of some pickets points upward, such that each of these pickets protrude a distance x from the upper surface of the upper rail, and a distance y from the lower surface of the lower rail, and a second end of the remaining pickets points upward, such that each of these pickets protrude a distance y from the upper surface of the upper rail, and a distance x from the lower surface of the lower rail, wherein y>x. In this configuration, the pickets may be arranged in a wide variety of patterns wherein some pickets protrude further from the upper rail than others. These patterns may include alternating tall and short pickets, alternating pairs of tall and short pickets, two tall pickets followed by one short picket followed by two more tall pickets, and so on.

In each of the above configurations, decorative finials may be placed upon the upper end of each picket, or upon the upper end of only select pickets, providing the fence with another configuration. The finials may be adapted to slidably fit around the outside or within the interior of the pickets. Instead of decorative finials, flat plugs may be inserted into the upper end of the pickets.

In another configuration, the upper rail is oriented channel-side-up, the lower rail is oriented channel-side-down, and a first end of each picket points upward, such that no picket protrudes from the upper surface of the upper rail, and each picket protrudes a distance y from the lower surface of the lower rail. In this configuration, an elongate cap may fit over the lower portion of the upper rail, thereby enclosing the channel and providing a smooth, continuous upper surface for the fence.

In each of the above configurations the retaining rod, clip, screw or other holding member is disposed within one of the upper slots. The member may also be disposed within one of the lower slots, which provides the fence with a further variety of configurations as will be apparent to one skilled in the art.

Further objects and advantages of this invention will become apparent as the following description proceeds, and the features of novelty that characterize the invention will be pointed out with particularity in the claims annexed to and forming a part of this specification.

BRIEF DESCRIPTION OF THE DRAWINGS

The preferred embodiments of this invention, illustrating its features, will now be discussed in detail. These embodiments depict the novel and non-obvious picket fence of this invention shown in the accompanying drawings, which are for illustrative purposes only. These drawings include the following figures, in which like numerals indicate like parts.

DETAILED DESCRIPTION OF THE PREFERRED EMBODIMENT

Figure 1A:
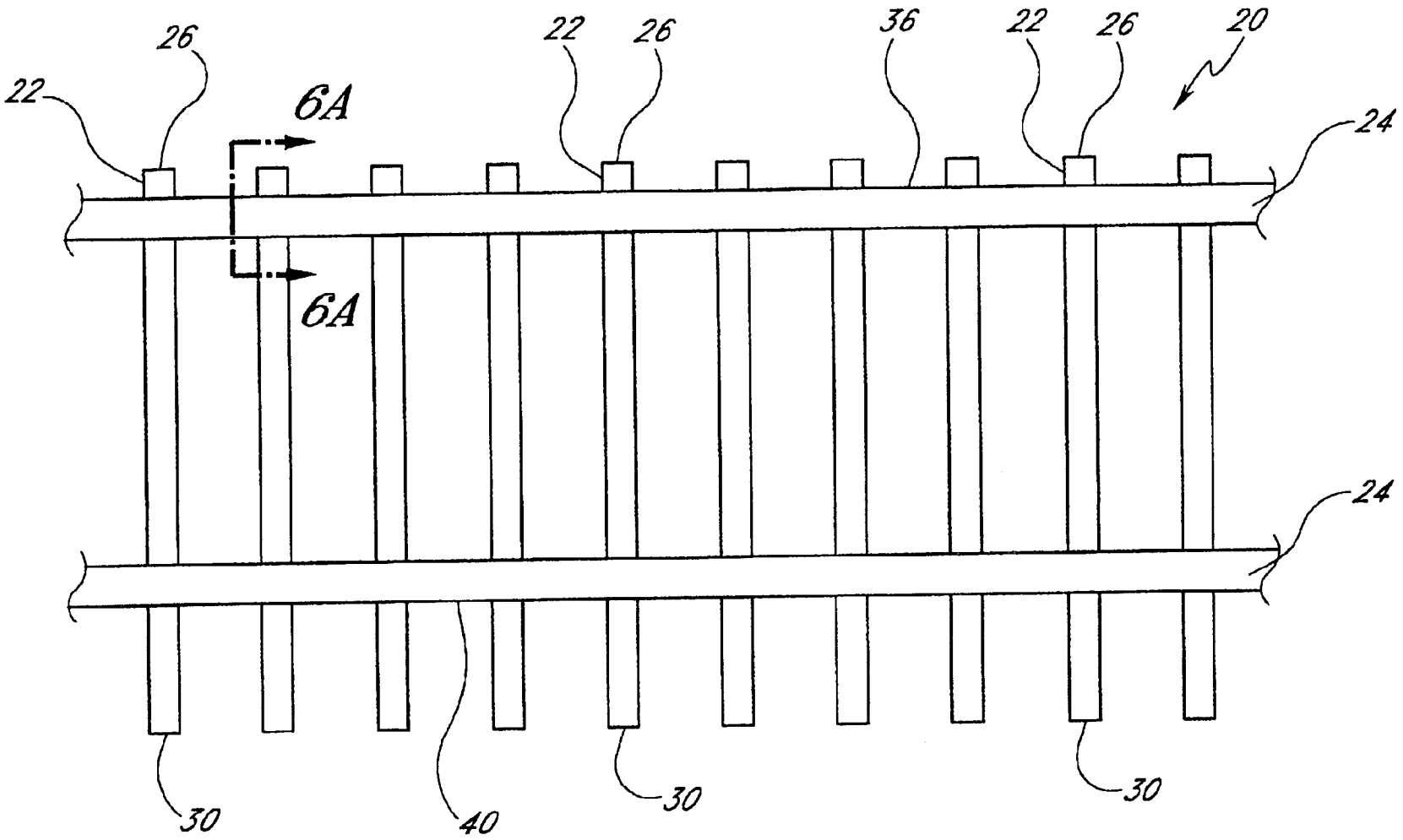
FIG. 1A is a front view of a portion of one embodiment of the assembled picket fence according to the present invention, wherein each picket extends a distance x above the upper surface of the upper rail.

Referring to FIGS. 1A-1F, a section of the picket fence 20 of the present invention is constructed of a series of substantially vertical pickets 22 that are secured by upper and lower rails 24. The rails 24 are secured at either end to posts (not shown) that are driven into the ground and provide support for the fence 20. The pickets 22, illustrated in detail in FIGS. 4A-4I, are preferably constructed of tubes having a substantially square cross-section. However, solid pickets, and pickets having cross-sectional shapes other than square would not depart from the teaching of the invention. Preferred materials for the pickets 22 include galvanized steel, black steel, aluminum and vinyl. However, a wide range of other rigid materials that are resistant to weathering are also satisfactory.

Referring to FIG. 4I, each picket 22 preferably includes a first end 26 having a first corresponding notch 28, and a second end 30 having a second corresponding notch 32. Either both notches 28, 32 may be located on the same face of the picket 22, as in FIG. 4I, or the notches may be located on opposite faces of the picket 22, as will be understood by one of skill in the art. Instead of notches, which may require cutting the picket 22, indentations 28, 32 may be stamped or punched into the picket face, as shown in FIGS. 4C-4F. The shape and size of each notch or indentation 28, 32 is appropriate to cooperate with the retaining rod, as described below.

The distance d from the first notch or indentation 28 to the first end 26 is preferably less than the distance D from the second notch or indentation 32 to the second end 30. Preferred distances are d=1" and D=6", although other distances would not depart from the teaching of the invention. Although the fence 20 is depicted in FIGS. 1A-1F as comprising only upper and lower rails 24, any number of intermediate rails 24 may be added to make the fence 20 more sturdy. Each picket 22 would then preferably include an additional notch or indentation for each additional rail 24.

Figure 5A:
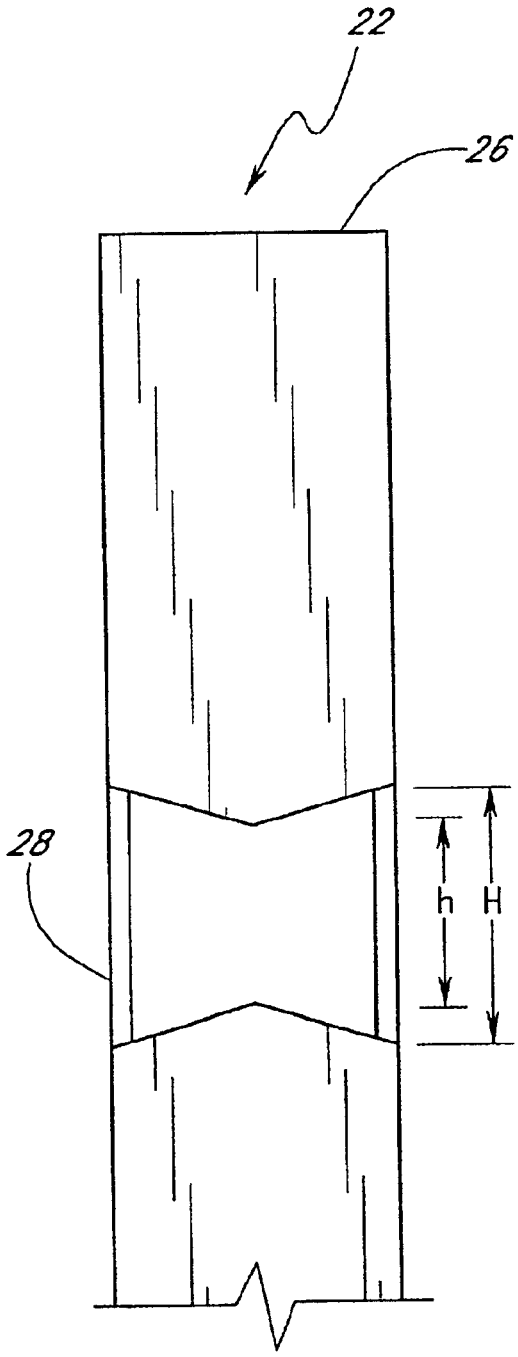
FIG. 5A is a front view of an upper portion of a preferred picket of the picket fence, illustrating a double-V notch.
Figure 5B:
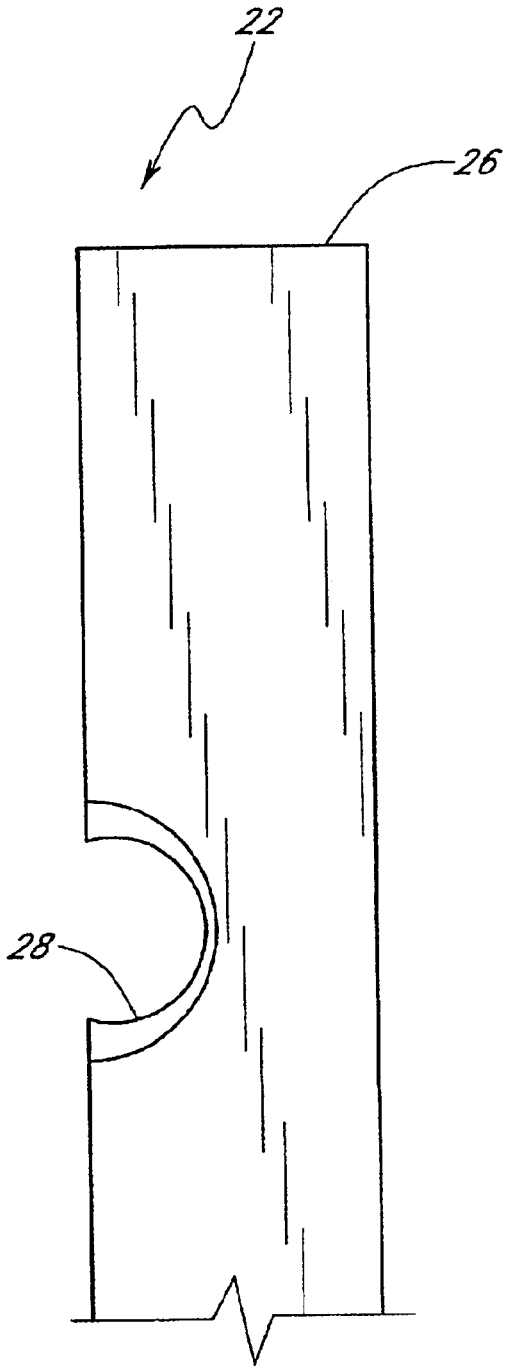
FIG. 5B is a right-side view of the picket of FIG. 5A.
Figure 5C:
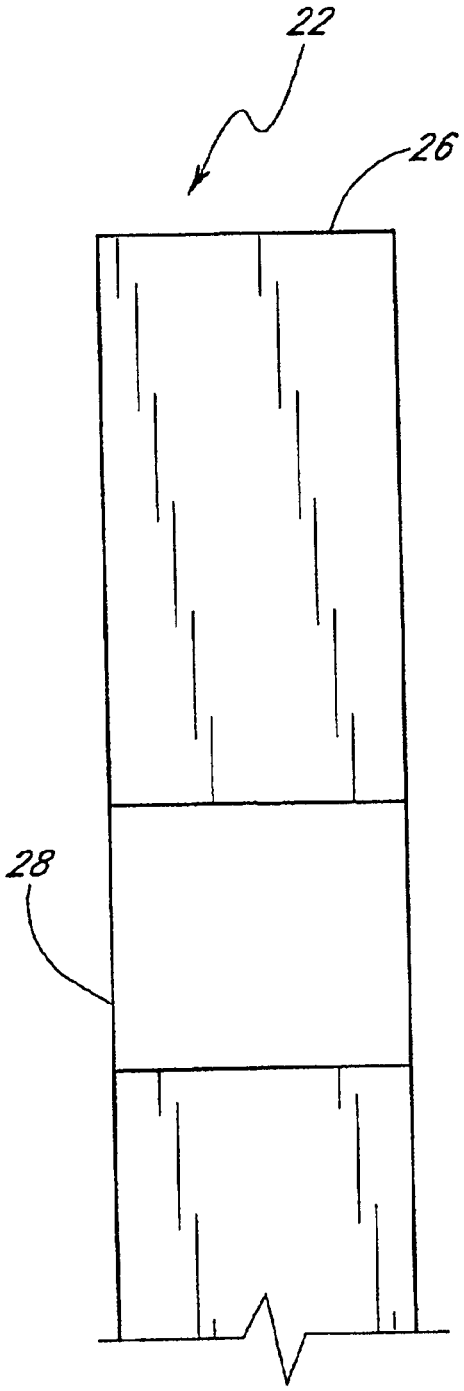
FIG. 5C is a front view of an upper portion of another preferred picket of the picket fence, illustrating a square indentation.
Figure 5D:
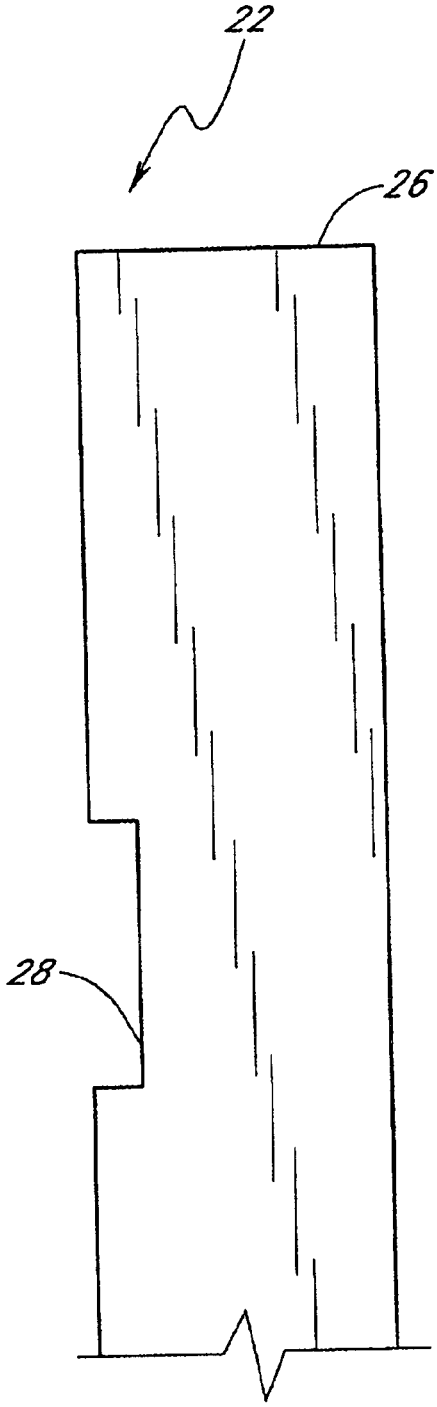
FIG. 5D is a right-side view of the picket of FIG. 5C.
Figure 5E:
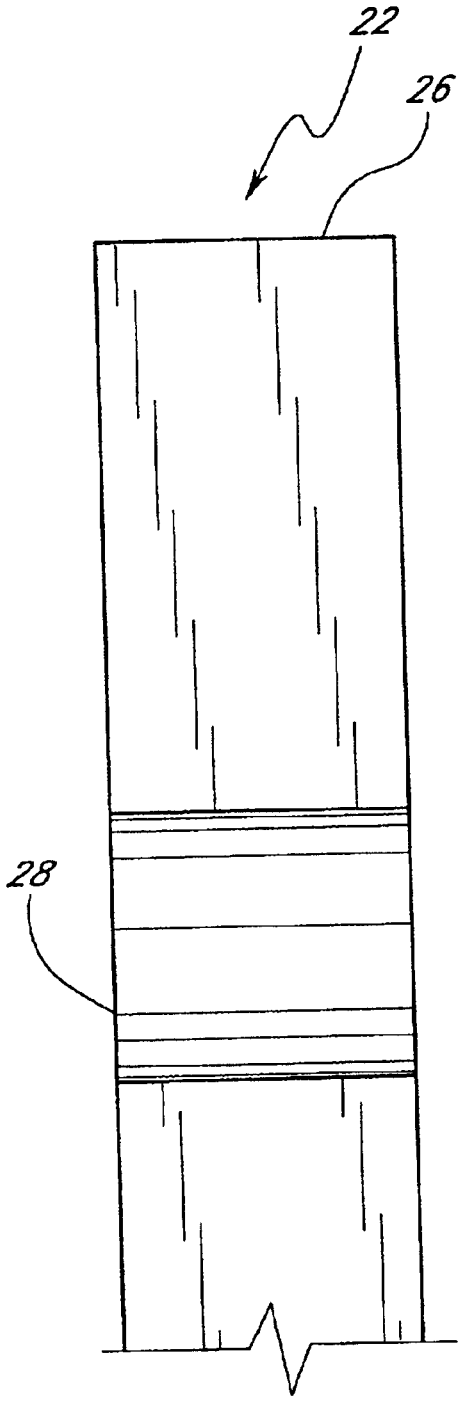
FIG. 5E is a front view of an upper portion of another preferred picket of the picket fence, illustrating a rounded indentation.
Figure 5F:
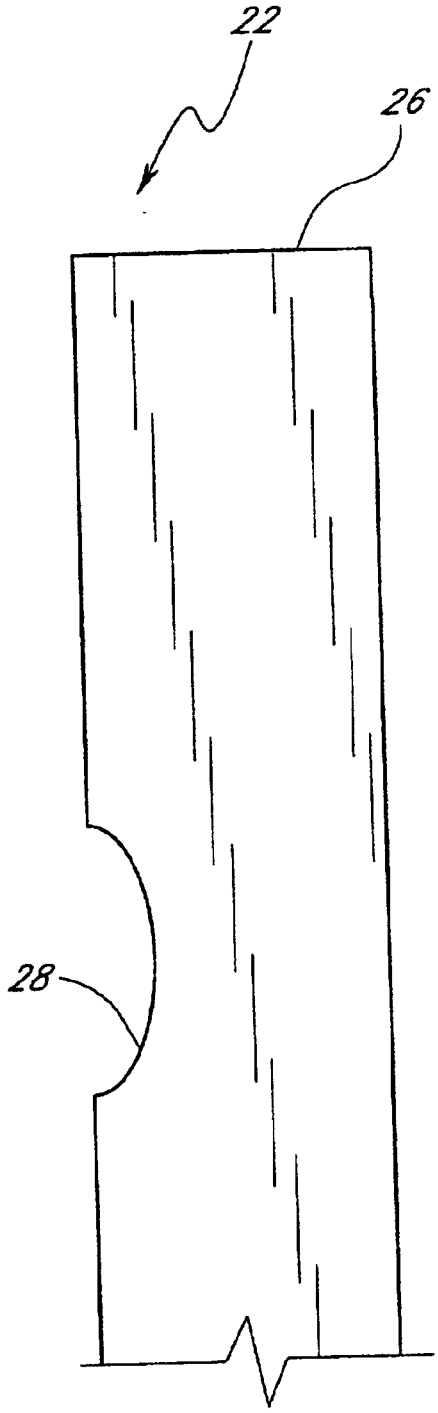
FIG. 5F is a right-side view of the picket of FIG. 5E.
Figure 5H:
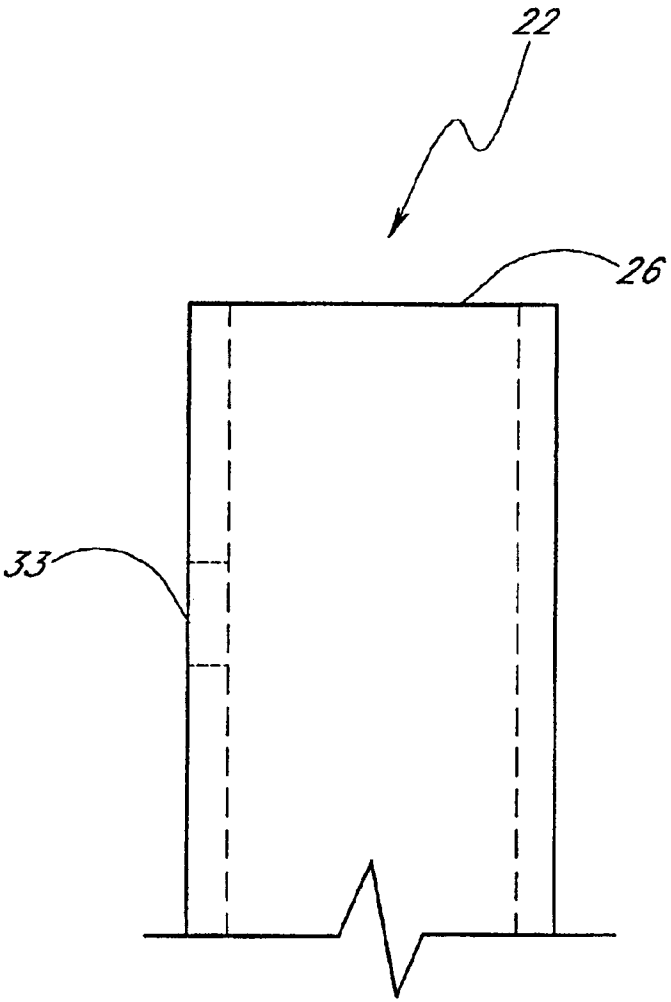
FIG. 5H is a right-side view of the picket of FIG. 5G.
Figure 5G:
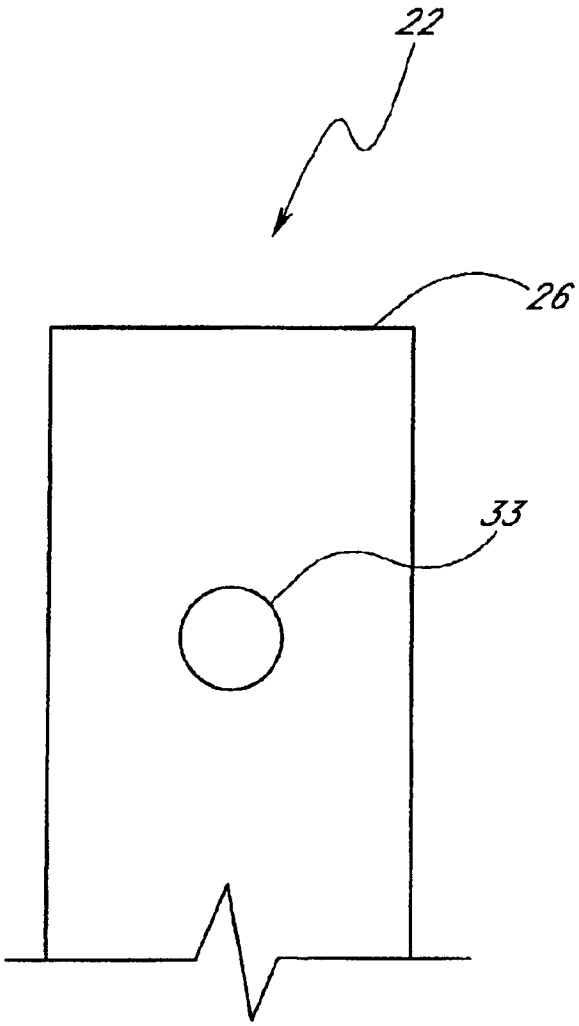
FIG. 5G is a front view of an upper portion of another preferred picket of the picket fence, illustrating a through-hole.
Figure 5I:
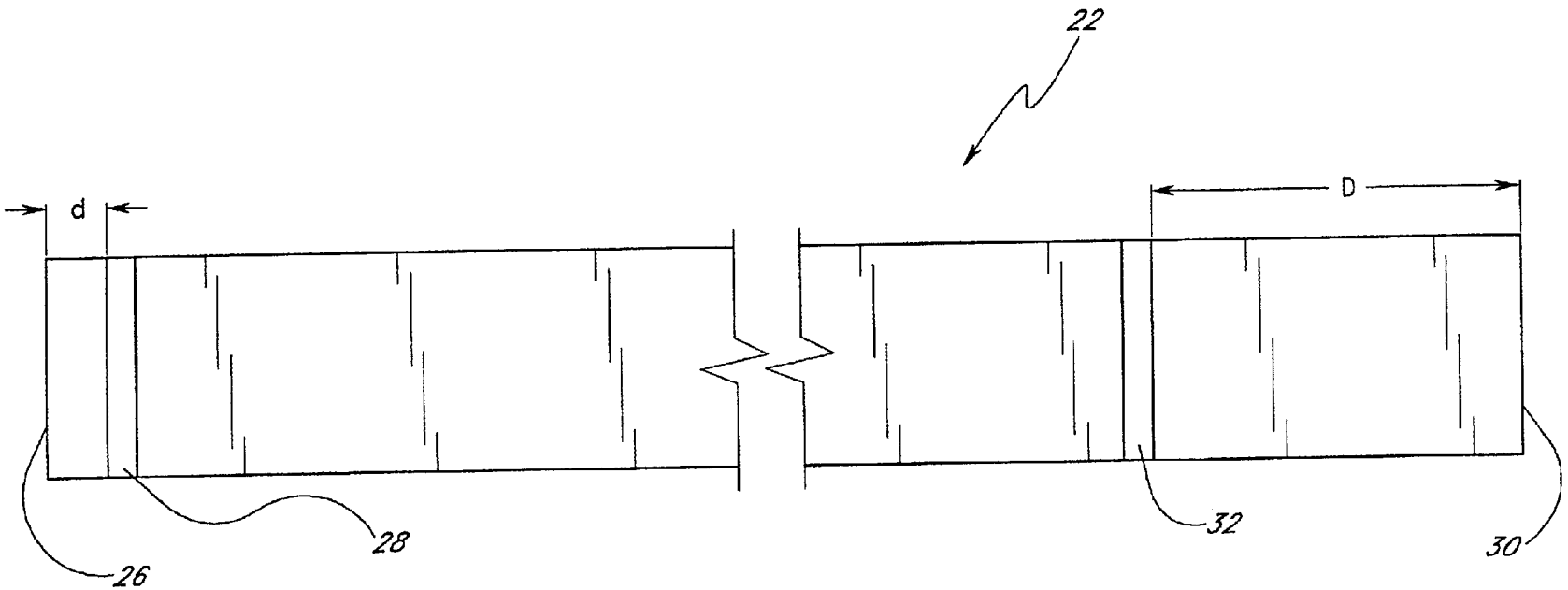
FIG. 5I is a front view of a preferred picket of the picket fence, illustrating the relative distances between each notch or indentation and its respective picket end.

In another preferred embodiment, the pickets 22 contain through-holes 33, as shown in FIGS. 5G-5H, rather than notches or indentations. The holes 33 are preferably positioned on the pickets 22 in a similar way as the notches 28, with a first hole being closer to the first picket end 26 than a second hole is to the second picket end 30. Further, rather than just one hole 33, each longitudinal position may instead have two holes 33, one hole 33 in opposite picket faces. The pickets 22 of this embodiment are adapted to be mounted to the rails with spring clips, screws, rivets or other suitable attachment members, as described below.

Figure 2A:
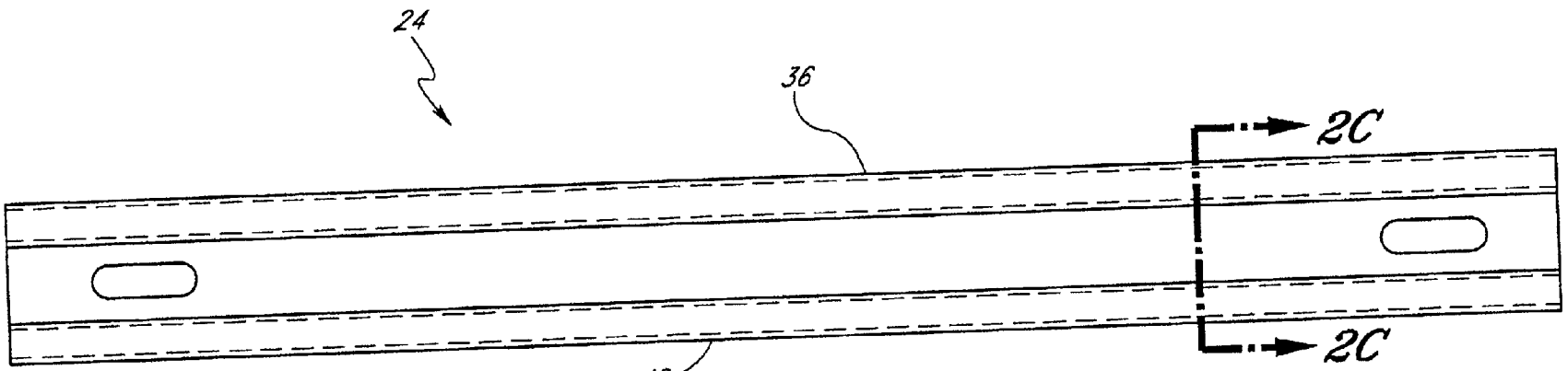
FIG. 2A is a front view of a preferred rail of the picket fence.
Figure 2B:
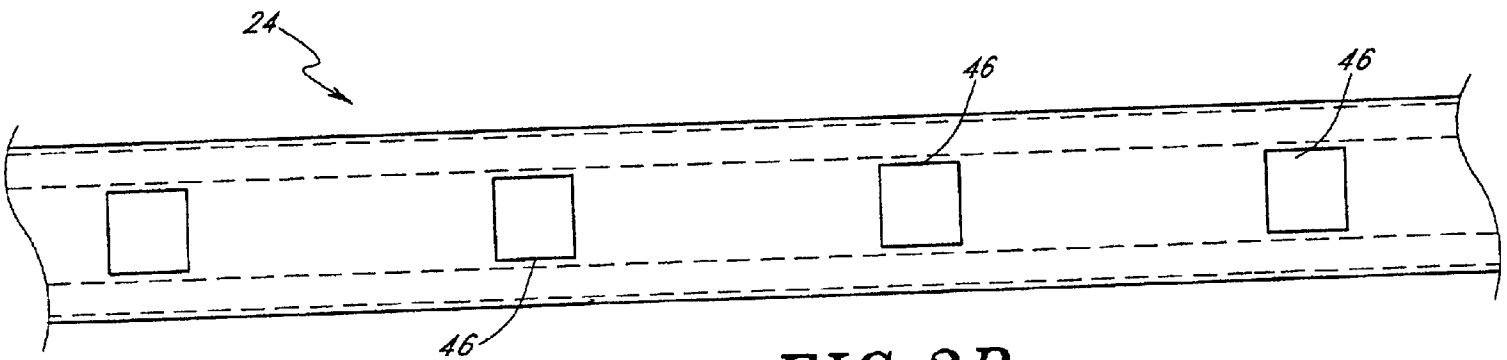
FIG. 2B is a top view of a portion of the rail of FIG. 2A.
Figure 2D:
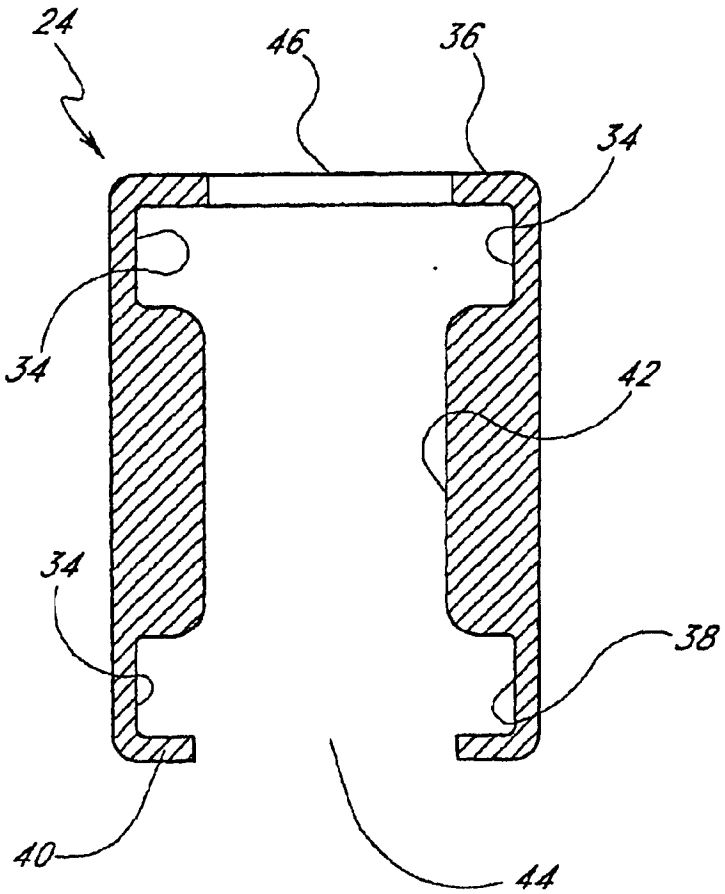
FIG. 2D is a left-side cross-sectional view of another preferred rail of the picket fence.
Figure 2C:
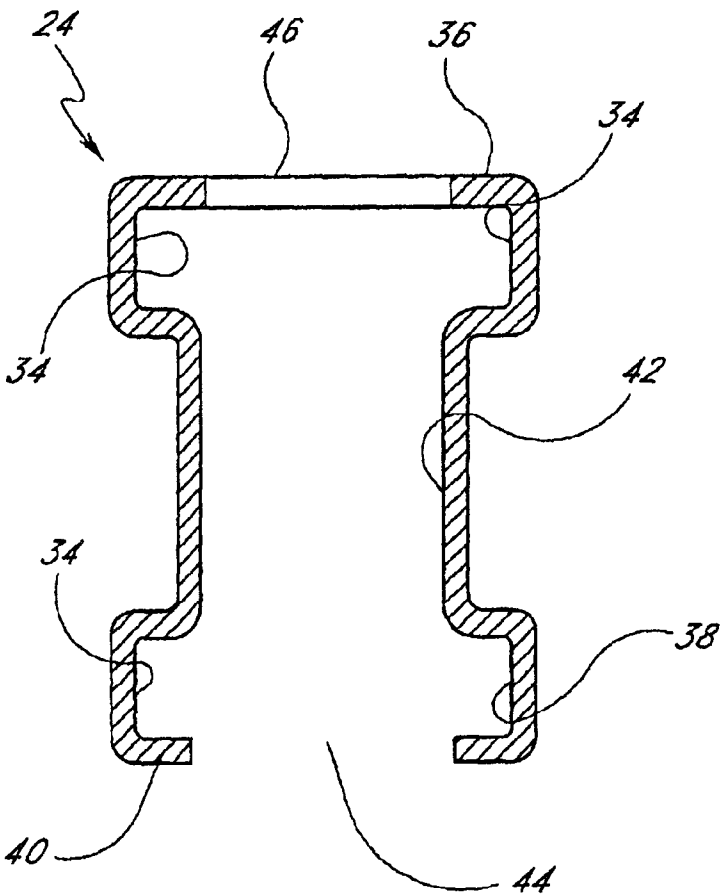
FIG. 2C is a left-side cross-sectional view of the rail of FIG. 2A.

The upper and lower rails 24 preferably have a hollow interior defining a substantially I-shaped cross-section, as shown in FIG. 2C. The I includes a pair of oppositely disposed upper slots 34 adjacent to an upper surface 36 of the rail, and a pair of oppositely disposed lower slots 38 adjacent to a lower surface 40 of the rail 24. Each upper slot 34 is connected by a web 42 to a lower slot 38.

Figure 2F:
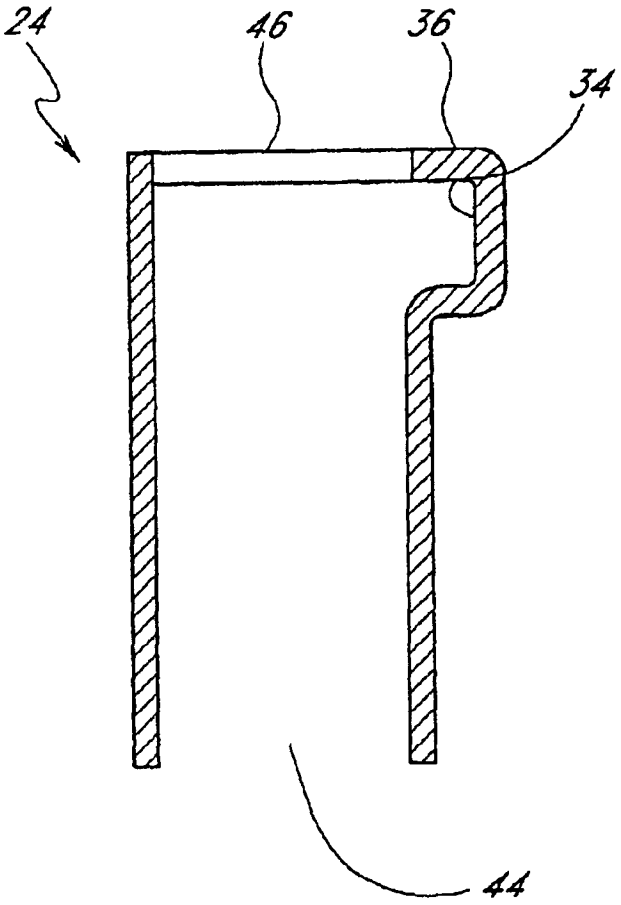
FIG. 2F is a left-side cross-sectional view of another preferred rail of the picket fence.
Figure 2E:
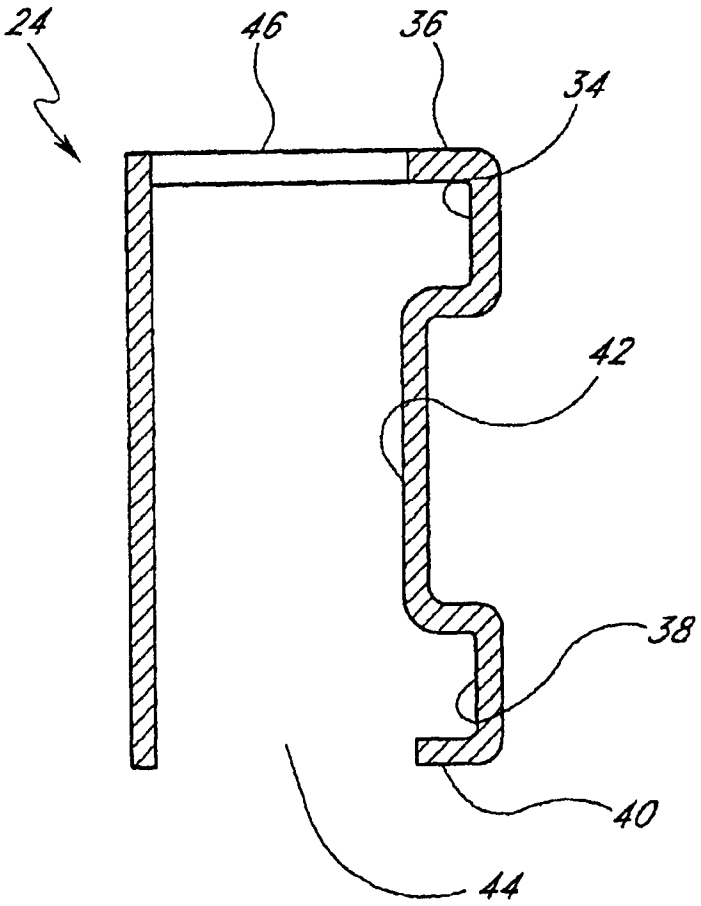
FIG. 2E is a left-side cross-sectional view of another preferred rail of the picket fence.

As will be apparent to one skilled in the art, some of the advantages of the present invention may be obtained using rails 24 of slightly different cross-section from that shown in FIG. 2C. FIGS. 2D-2F illustrate such exemplary rail cross-sections. The exterior of the rail 24 may conform to the I-shape of the interior, as in FIG. 2C, or the exterior may be any of a wide range of shapes as desired, including rectangular, circular, hexagonal, etc. FIG. 2D illustrates a rail 24 having a substantially rectangular exterior.

Regardless of the exterior shape, the bottom edge of the rail cross-section preferably contains a central gap. This gap extends along the longitudinal axis of the rail 24 from one end to the other, creating a channel 44. The top surface 36 of the rail 24 includes a series of evenly spaced openings 46 along the longitudinal axis. The openings 46 are located substantially in the center of the lateral width of the rail 24, and have a shape that corresponds to the cross-sectional shape of the pickets 22. The dimensions of the openings 46 allow a loose fit between the openings 46 and the pickets 22. The lateral width of the channel 44 is likewise wide enough to accommodate the pickets 22, with a small amount of clearance on each side. Like the pickets 22, preferred materials for the rails 24 include galvanized steel, black steel, aluminum, vinyl, and a wide range of other rigid materials that are resistant to weathering.

Figure 3A:
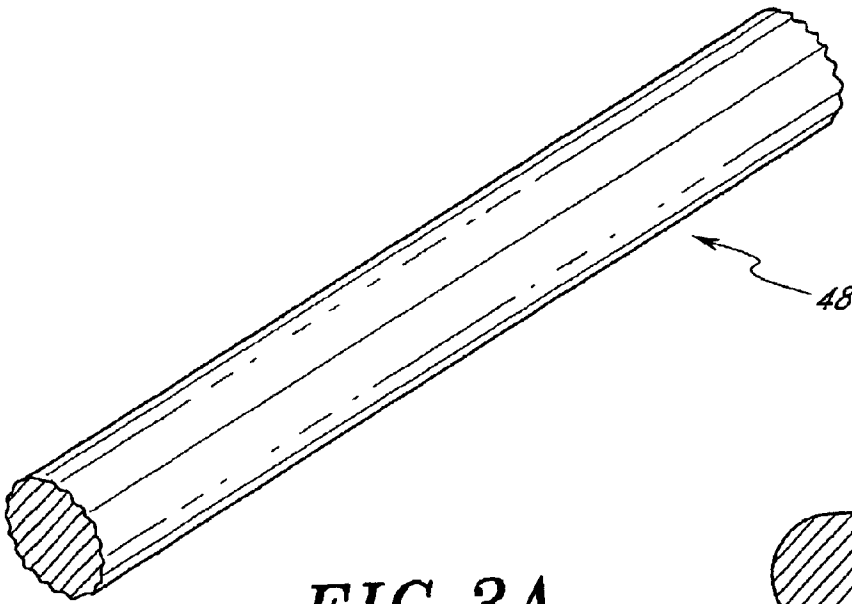
FIG. 3A is a perspective view of a portion of a preferred retaining rod of the picket fence.
Figure 3C:
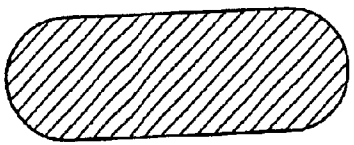
FIGS. 3B-3E are side cross-sectional views of other preferred retaining rods of the picket fence.
Figure 3B:
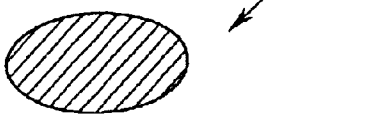
Figure 3D:
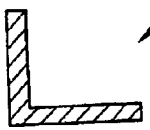
Figure 3E:
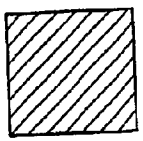

In one preferred embodiment, the pickets 22 are secured to the rails 24 by a retaining rod 48, illustrated in FIG. 3A. The retaining rod 48 is preferably cylindrical, as in FIG. 3A, however a wide range of alternate cross-sectional shapes, such as oval, FIG. 3B, flat bar, FIG. 3C, L-shaped, FIG. 3D, and square, FIG. 3E, could also be used without departing from the teaching of the invention.

Figure 4:
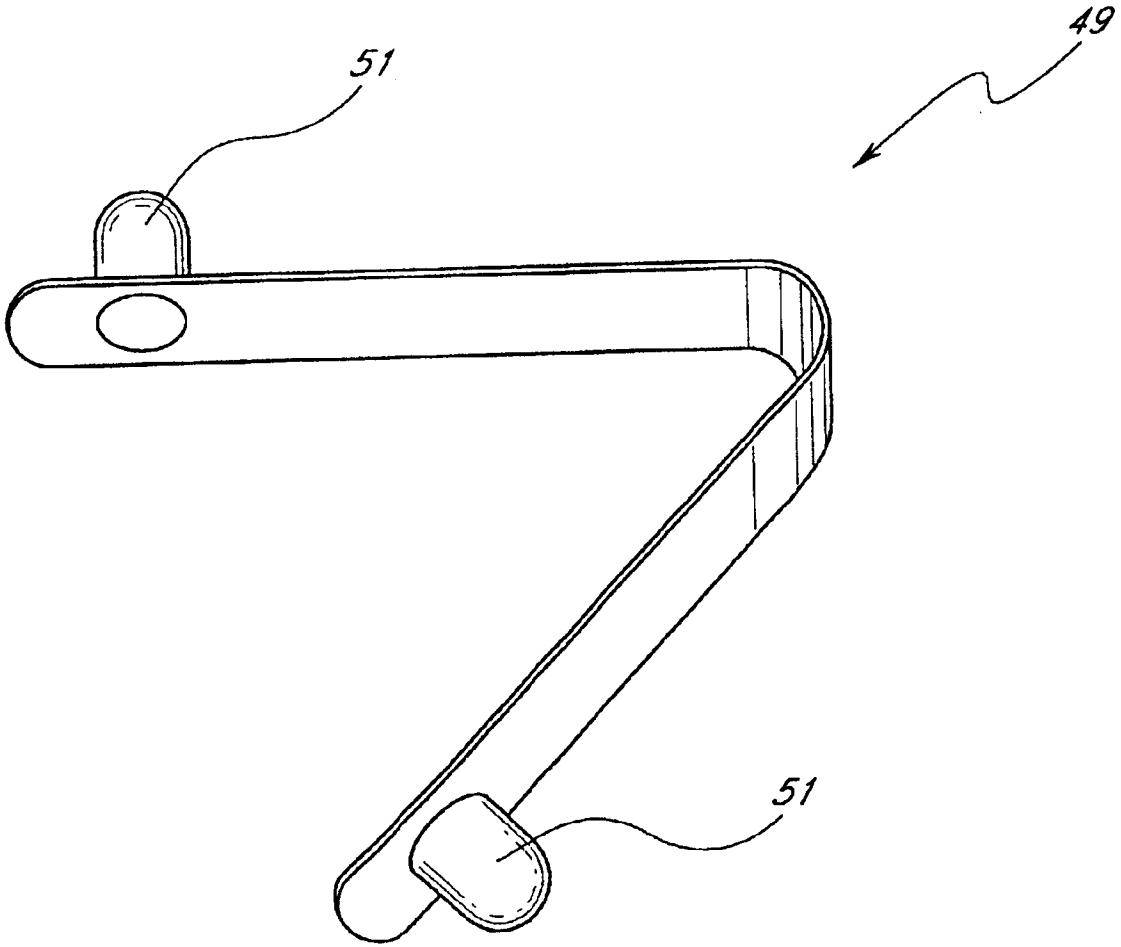
FIG. 4 is a perspective view of a preferred spring clip of the picket fence.

In another preferred embodiment, the pickets 22 are secured to the rails 24 with spring clips 49, shown in FIG. 4, screws, rivets or other suitable attachment means, as described below. Each spring clip comprises a thin strip of metal bent into a V-shape, such that when the sides of the V are squeezed together, a spring force tends to return the clip to its original V-shape. A pin 51 protrudes outwardly in a transverse direction from the end of each side of the V. The pins 51 cooperate with the rail slots to secure the pickets to the rails, as described below.

Figure 6A:
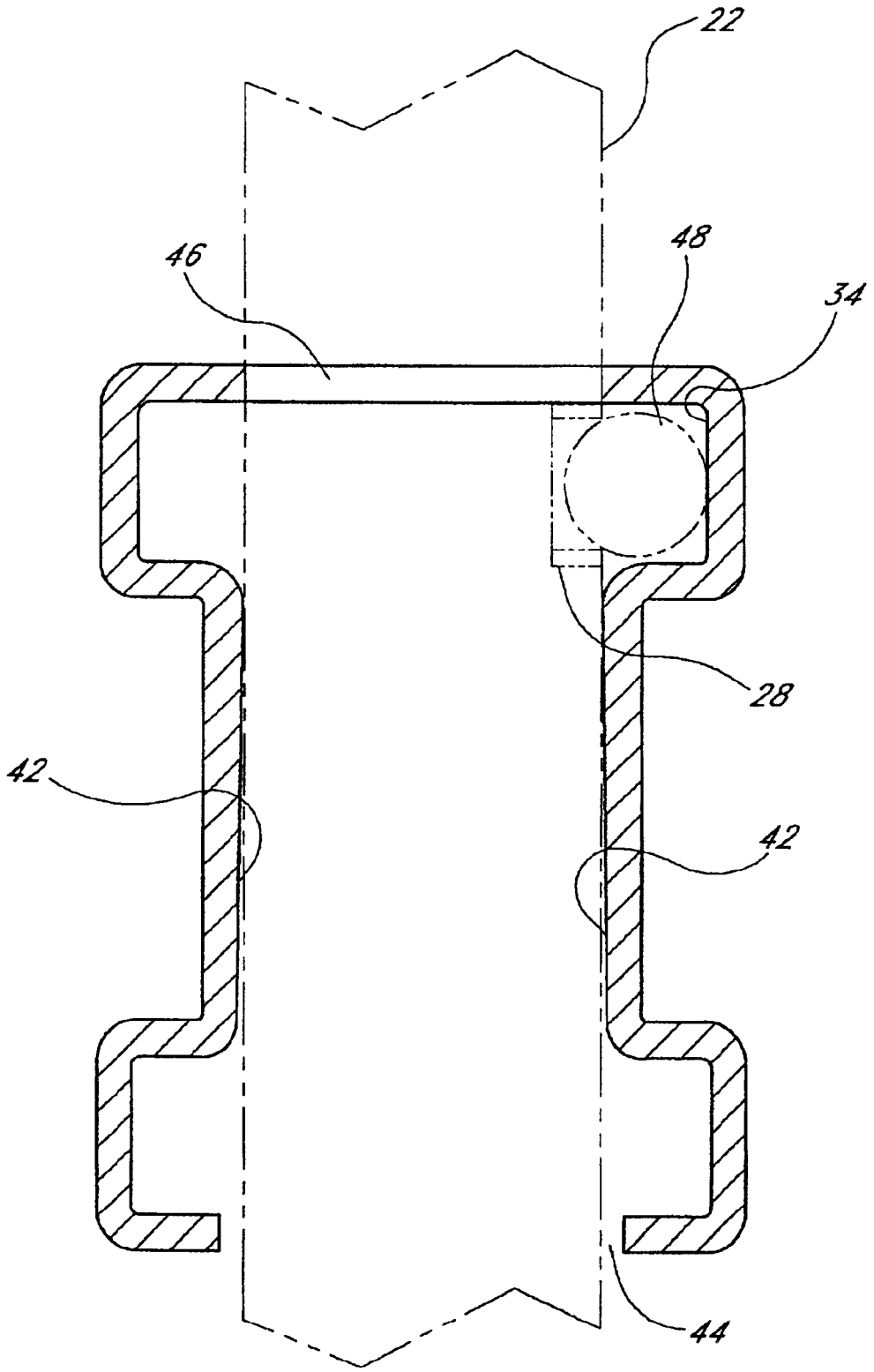
FIG. 6A is a left-side cross-sectional view of an upper rail and an upper portion of a picket of the picket fence, illustrating a relative configuration of the rail and picket wherein the retaining rod is disposed within an upper slot of the rail and the picket protrudes from the upper surface of the upper rail.
Figure 10:
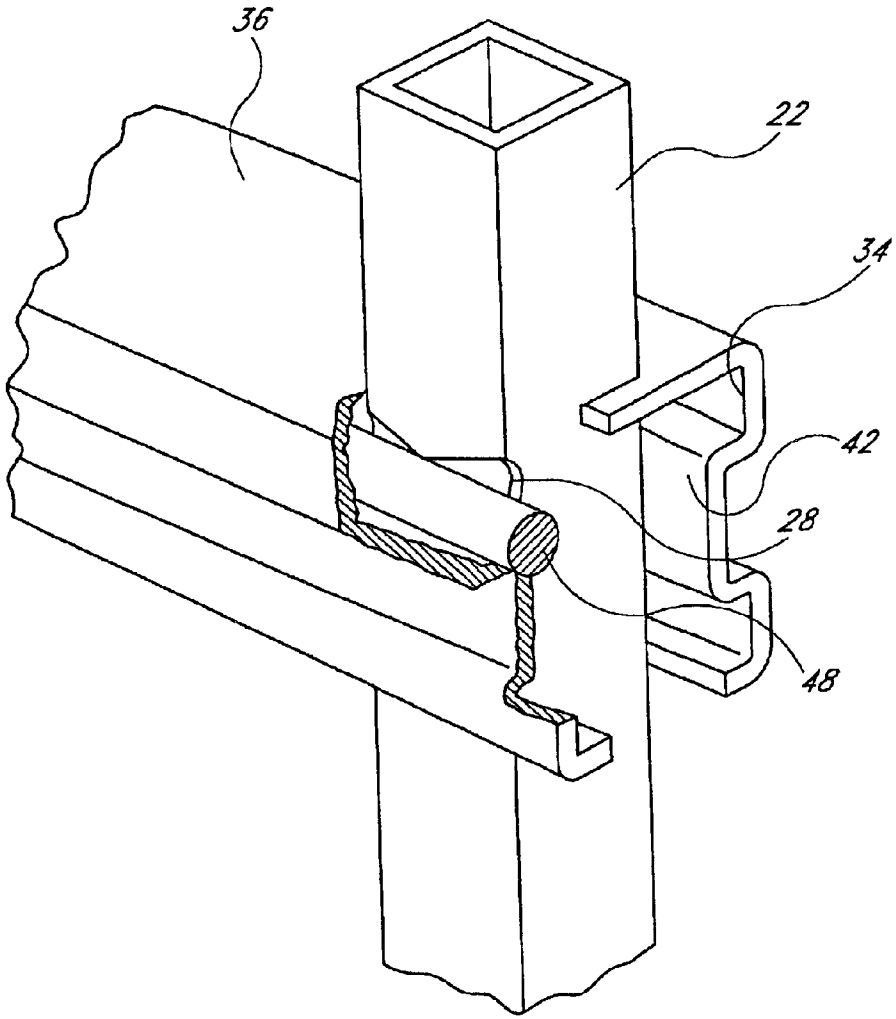
FIG. 10 is a perspective view of a picket/rail/retaining rod junction of the picket fence, including a cut-away portion illustrating the mating of the rod and picket.

In one preferred configuration, shown in FIG. 6A, each picket 22 projects through the channel 44 in the lower surface 40 of the rail 24, and through one opening 46 in the top surface 36 of the rail 24, such that the first notch 28 is laterally adjacent the upper slot 34 of the rail 24. With the picket 22 in this position, the retaining rod 48 is slidable within the upper slot 34, thereby engaging the notch 28, as shown in FIG. 10. The retaining rod 48 has outer dimensions such that it fits snugly within the space defined by the inside surfaces of the slot 34, while still sliding easily. The height of the notch 28 similarly corresponds to the outer dimensions of the rod 48, so that the picket 22 is slidable vertically only a small amount, and preferably not at all, with respect to the rail 24.

The distance between the inside surfaces of the web 42 is only slightly larger than the width of the picket 22. Thus, the picket 22 is constrained from moving laterally away from the rod 48 far enough to allow the notch or indentation 28 to disengage the rod 48. Thus, once the rod 48 is slid into the upper slot 34, each picket 22 is locked with respect to the rail 24.

Figure 6B:
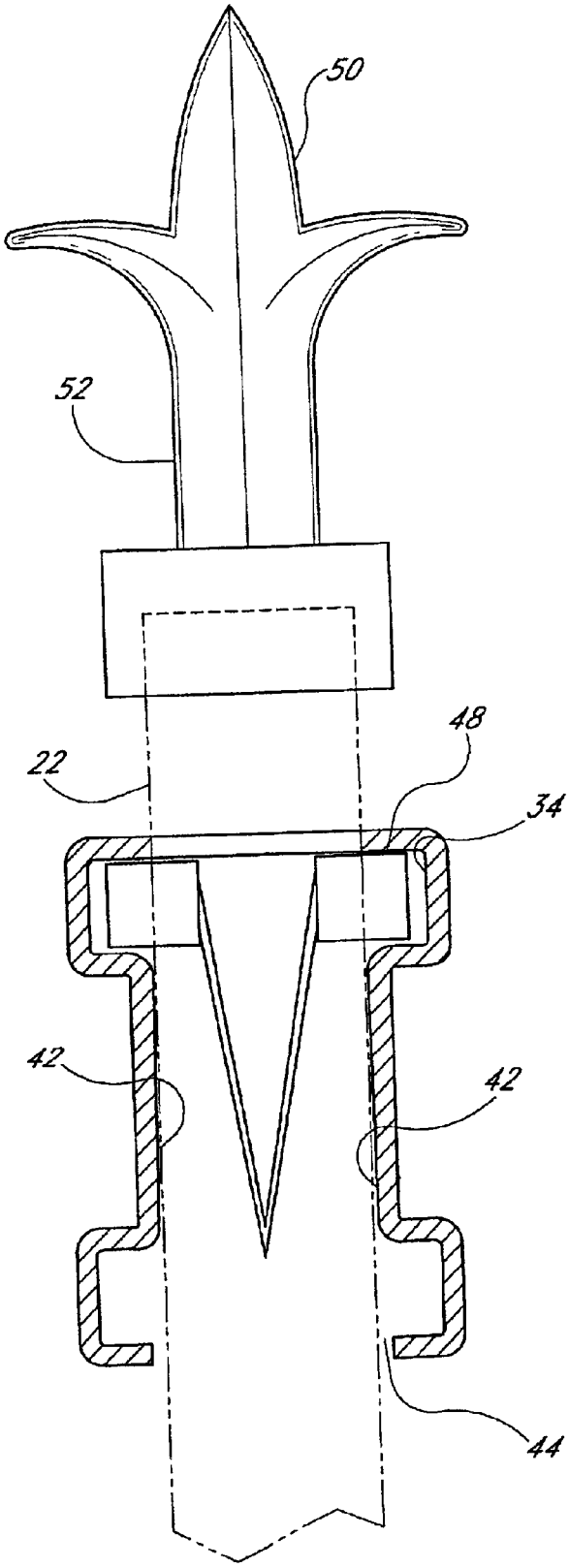
FIG. 6B is a left-side cross-sectional view of an upper rail and an upper portion of a picket of the picket fence, illustrating the cooperation of a spring clip and a rail channel, and a decorative finial secured to the top of the picket.

In another preferred configuration, shown in FIG. 6B, the relative positions of the picket 22 and rail 24 are as in FIG. 6A above. However, a spring clip 49 resides within the picket 22 such that pins 51 project outwardly through oppositely facing holes 33 in the picket 22. By pinching the pins 51 inwardly, the picket 22 is slidable downwardly through an opening 46 until the pins 51 pop out into the upper slot 34. The spring force within the spring clip 49 retains the pins 51 in this position, where they cooperate with the upper slot 34 to prevent the picket 22 from translating vertically with respect to the rail 24.

Figure 6C:
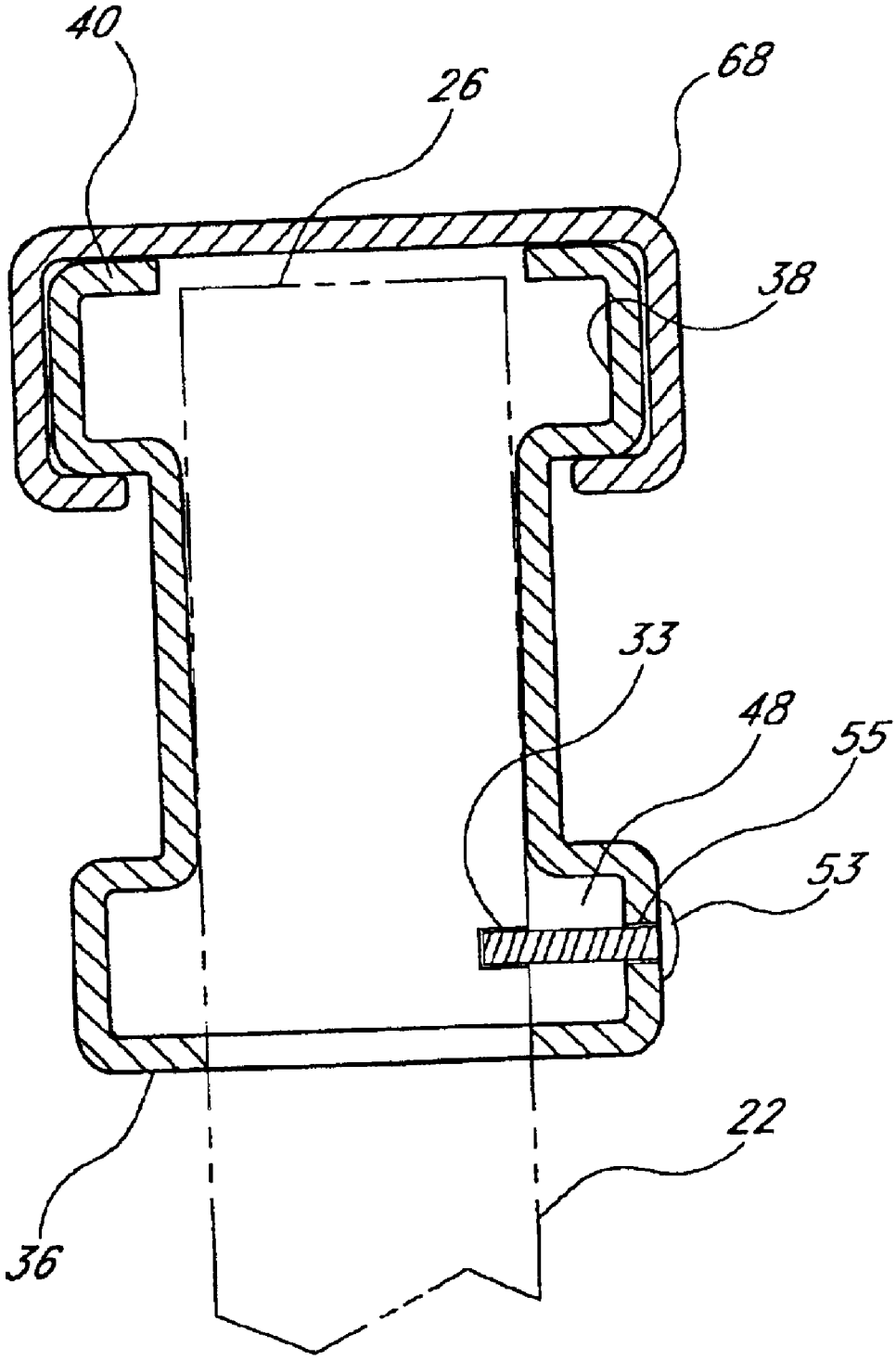
FIG. 6C is a left-side cross-sectional view of an upper rail and an upper portion of a picket of the picket fence, illustrating a relative configuration of the rail and picket wherein the rail is inverted and a screw secures the picket to the rail so that the picket is enclosed by the rail and a cap covers the rail channel.

In another preferred configuration, shown in FIG. 6C, the upper rail 24 is inverted as compared to FIGS. 6A and 6B. The picket hole 33 is again adjacent the rail upper slot 34, but due to the inversion of the rail 24, the lower slot 38 is above the upper slot 34. Preferably, the height of the rail 24 is sufficient such that the first picket end 26 does not extend above the lower rail surface 40. A protective cap 68, preferably having a length about the same as the rail 24, is slidable over the upwardly facing rail lower surface 40 to cover the channel 44 and hide the first picket ends 26. From the outside, the fence 20 of this configuration includes a smooth, continuous top surface having no protruding pickets 22.

In this embodiment, each picket 22 may be secured to the rail 24 with a retaining rod 48 or spring clips 49, as in the embodiments of FIGS. 6A and 6B, respectively, or suitable threaded fasteners, such as the screw 53 pictured in FIG. 6C. If threaded fasteners are used, the rail 24 preferably contains transverse holes 55 through the sidewall of the upper slot 34. The positions of the holes 55 preferably correspond to the positions of the pickets 22, and each hole is preferably of suitable size to accept a threaded fastener.

One preferred shape for the notch 28 is depicted in FIGS. 5A-5B. This unique shape facilitates the relative orientation of the picket 22 and rod 48 between a range of angles. When viewing the notch 28 from the front, as in FIG. 5A, the height H of the notch 28 at either end is greater than the height h of the notch 28 at its center. The upper portion of the notch 28 is substantially V-shaped, having a vertex near the longitudinal centerline of the picket 22 face. The lower portion is a mirror image of the upper portion, being spaced from the upper portion to create a gap between the vertices. The rod 48 may thus be disposed relative to the picket 22 at any angle between the boundaries defined by the notch 28 slopes. Because the orientation of the rail 24 corresponds to the orientation of the rod 48, the rail 24 may also be disposed at a variety of angles relative to the picket 22.

The indentations in FIGS. 5C-5F similarly allow the relative orientations of the picket 22 and rod 48 to vary between a range of angles, because the height of the indentation 28 is greater than the outside dimension of the portion of the rod 48 that fits within the indentation 28. Thus, with the picket 22, rail 24 and rod 48 assembled, the picket 22 is rotatable relative to the rod 48 to a point where an upper portion of the rod 48 contacts an upper corner of the indentation 28, and a lower portion of the rod 48 contacts a diagonally opposite lower corner of the indentation 28.

The embodiments including spring clips 49, screws 53, rivets, or other suitable fastening members other than a rod 48, also allow the relative orientations of the picket 22 and rail 24 to vary between a range of angles. Each picket 22 is preferably configured to pivot about its fastening members. For pickets 22 mounted with spring clips 49, the pins 51 are preferably small enough to rotate freely within the upper channel 34. For pickets 22 mounted with screws 53, the holes 33 are preferably large enough to allow the screws 53 to rotate within them.

This range of angles allows the fence 20 to be easily installed on sloping terrain. As explained above, each rail 24 is mounted at its ends to posts that are driven into the ground. If the posts are not substantially parallel, the distance between the upper ends of two neighboring posts will not be equal to the distance between the lower ends of the same posts. Because each rail 24 is substantially the same length, the rails 24 will not line up properly with the posts if the posts are not parallel. It is thus advantageous to be able to drive each post vertically into the ground.

With the current invention, all posts may be driven into the ground vertically, and the rails 24 mounted such that they are substantially parallel with the sloping ground. Because the pickets 22 are rotatable relative to the rails 24, the pickets 22 remain substantially vertical. The result is a fence 20 that is both easy to set up, and aesthetically pleasing, because all posts and pickets 22 are substantially parallel to one another.

The fence 20 of the present invention is also extremely versatile. The unique shape of the rails 24, coupled with the unique spacing of the picket notches 28, 32, creates numerous relative configurations for the rails 24 and pickets 22. In one preferred configuration, shown in FIG. 1A, the upper and lower rails 24 are oriented channel-side-down, each retaining rod 48 is disposed within an upper slot 34 of each rail 24, and the first end 26 of each picket 22 points upward. In this configuration, each picket 22 protrudes a distance x from the upper surface 36 of the upper rail 24, and a distance y from the lower surface 40 of the lower rail 24. Because the second notch 32 is spaced further from the second end 30 than the first notch 28 is spaced from the first end 26, the distance y is greater than the distance x.

Although this configuration is described as including a retaining rod 48, the same configuration can be built using spring clips 49, screws 53 or other suitable fastening members. In fact, all the configurations described herein can be built using any of the attachment devices herein described, as well as other equivalent devices. For simplicity, and without limiting the scope of the invention, the remaining configurations will be described as including a retaining rod 48 only.

Figure 1B:
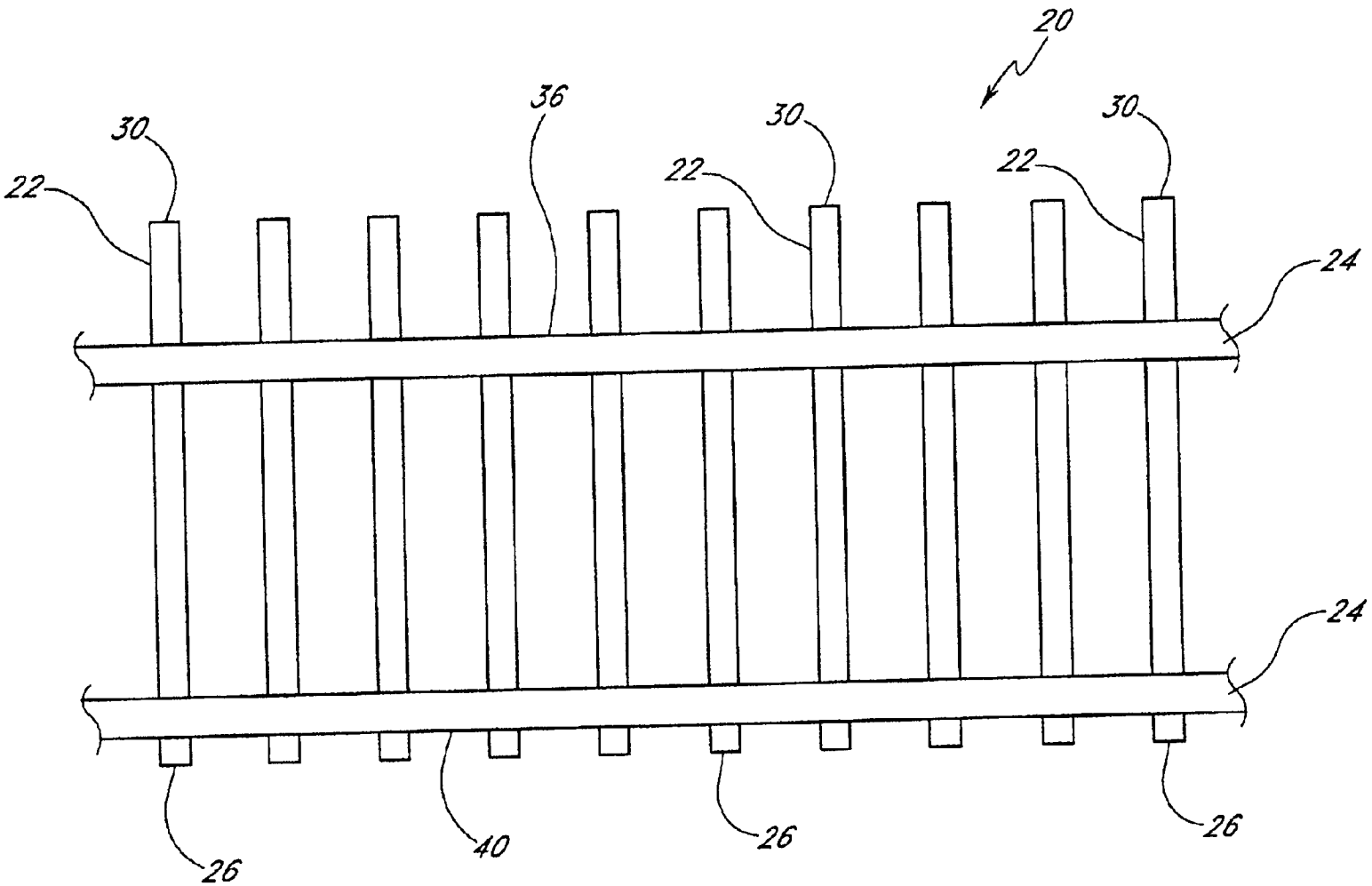
FIG. 1B is a front view of a portion of another embodiment of the assembled picket fence, wherein each picket extends a distance y above the upper surface of the upper rail.

By maintaining the configuration described above with reference to FIG. 1A, but inverting each picket 22, each picket 22 protrudes a distance y from the upper surface 36 of the upper rail 24, and a distance x from the lower surface 40 of the lower rail 24. This configuration is shown in FIG. 1B.

Figure 1C:
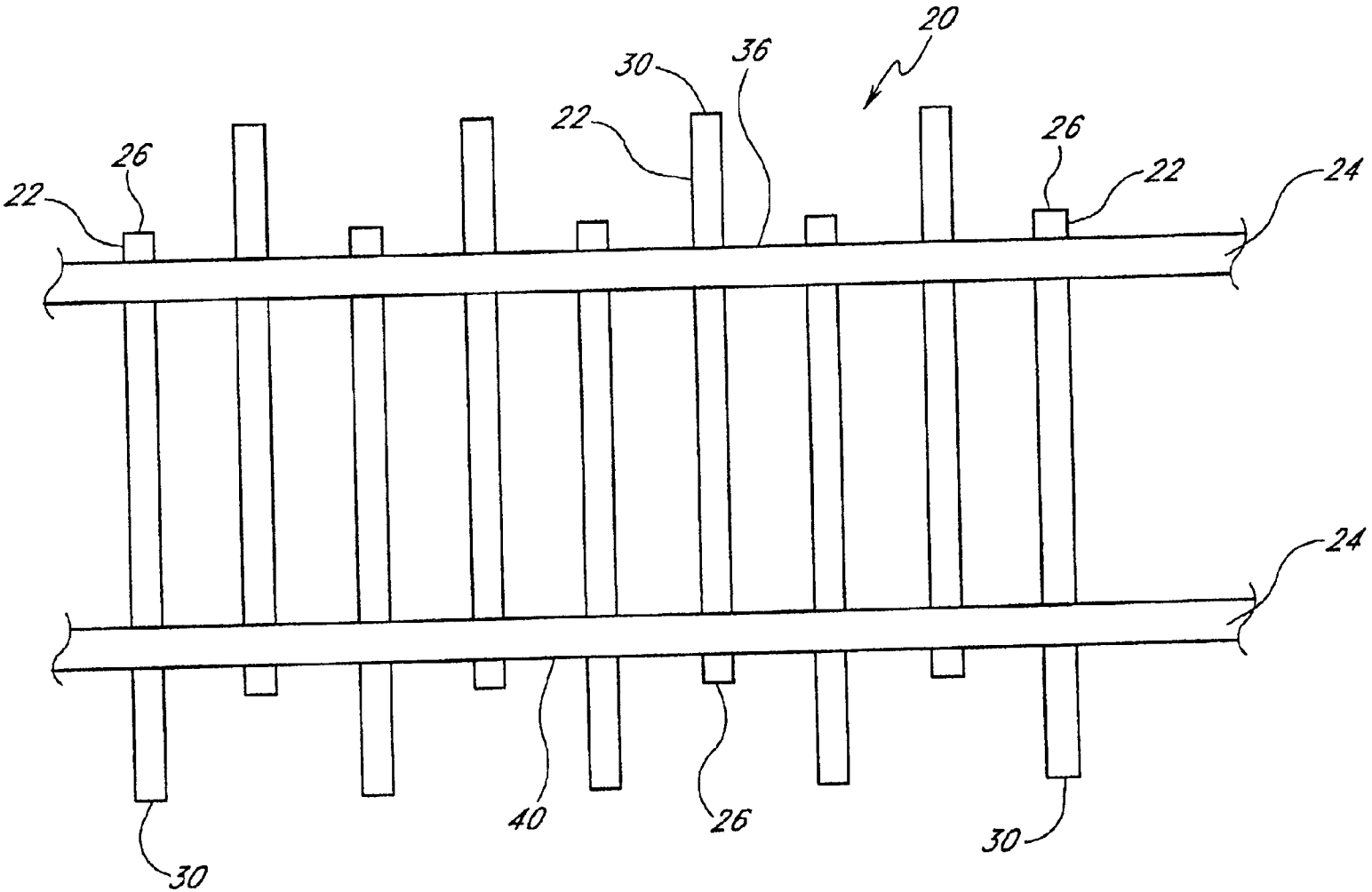
FIG. 1C is a front view of a portion of another embodiment of the assembled picket fence, wherein a first set of pickets extends a distance x above the upper surface of the upper rail, and a second set of pickets extends a distance y above the upper surface of the upper rail.

In each of the two configurations just described all of the pickets 22 are aligned with one another. In the first configuration, all pickets 22 extend a distance x above the upper rail 24, and in the second configuration, all pickets 22 extend a distance y above the upper rail 24. If desired, however, some pickets 22 may be oriented so that they extend a distance x above the upper rail 24, as described above, and the remainder of the pickets 22 oriented so that they extend a distance y above the upper rail 24. One example of this configuration is illustrated in FIG. 1C. In this configuration, both upper and lower rails 24 are preferably oriented channel-side-down, and each retaining rod 48 is preferably disposed within an upper slot 34 of each rail 24.

With the pickets 22 configured so that they do not extend a uniform distance above the upper rail 24, they may be arranged in a variety of alternating patterns, or in a random fashion. Desirable patterns may include alternating single tall and short pickets 22, alternating pairs of tall and short pickets 22, and pairs of tall pickets 22 alternating with single short pickets 22. Many other patterns are possible, and the foregoing examples are not intended to be limiting.

Figure 1D:
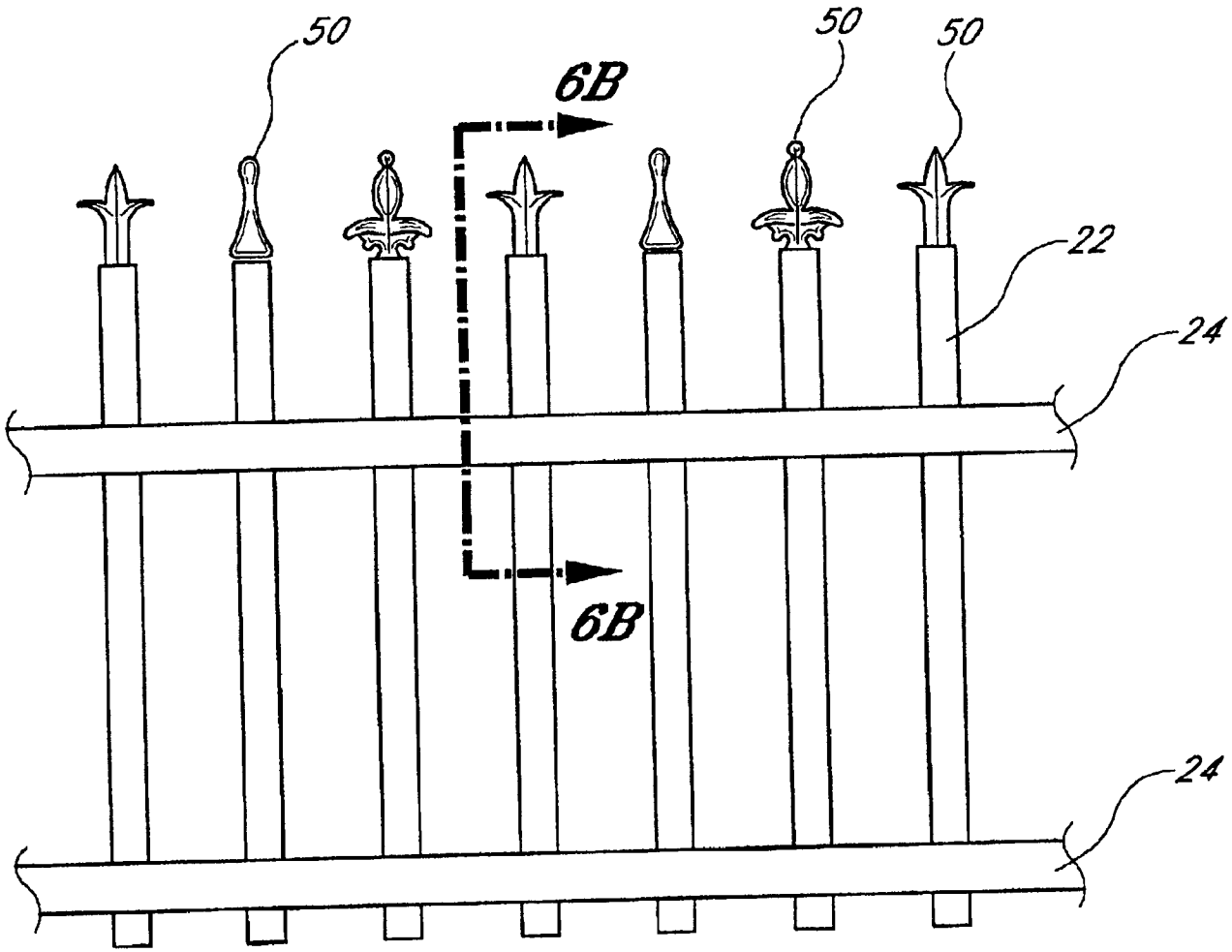
FIG. 1D is a front view of a portion of another embodiment of the assembled picket fence, wherein each picket extends a distance y above the upper surface of the upper rail, and decorative finials top each picket.
Figure 1E:
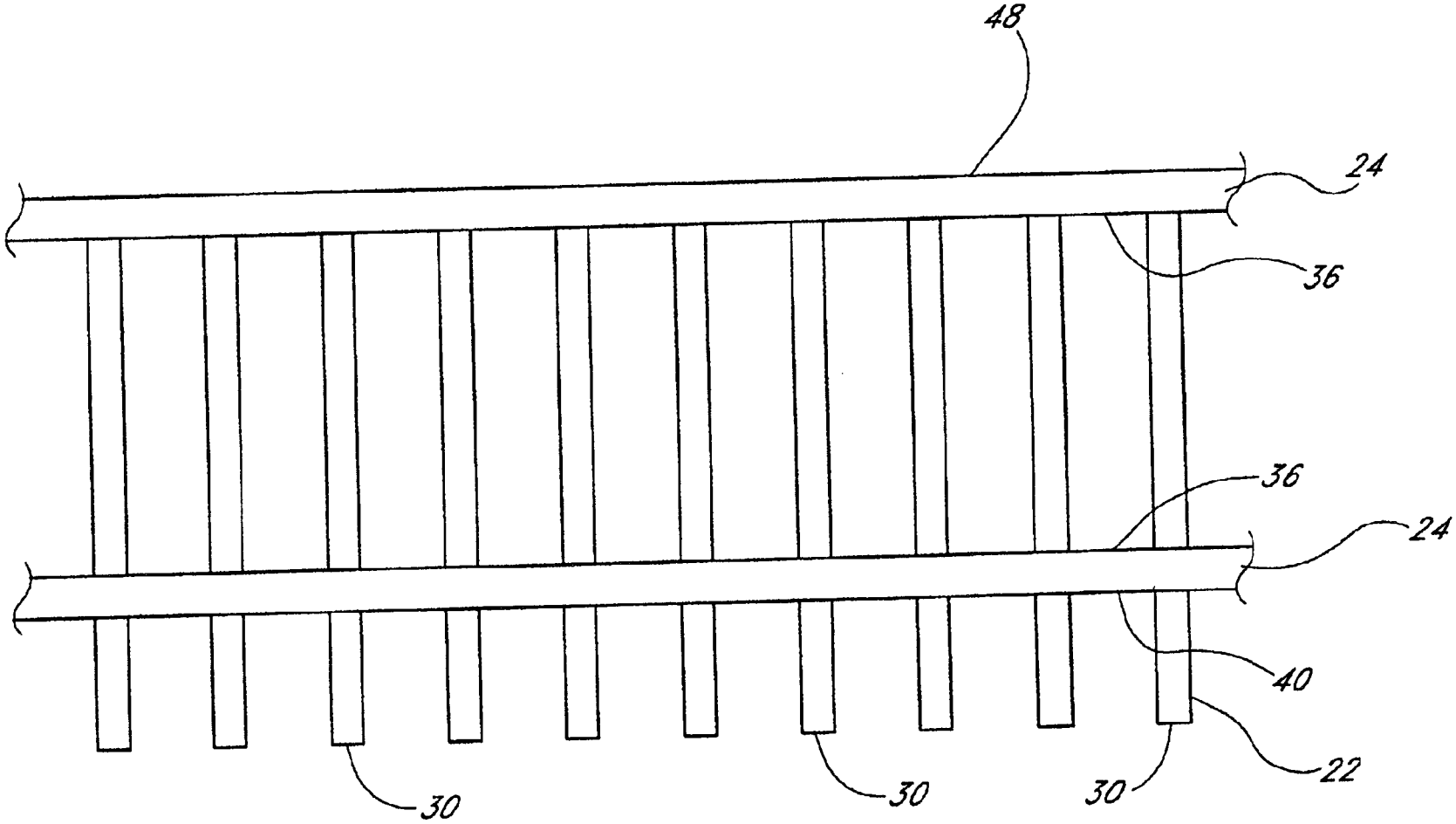
FIG. 1E is a front view of a portion of another embodiment of the assembled picket fence, wherein the upper rail is inverted and a cap covers the lower portion of the upper rail to provide the upper portion of the fence with a smooth appearance.

In each of the above configurations, decorative finials 50 may be placed upon the upwardly facing end of each picket 22, or upon the upwardly facing end of only select pickets 22. One configuration including decorative finials 50 is shown in FIG. 1D. Each finial 50 preferably includes a lower portion 52 that is adapted to either slidably fit around the outside of a picket 22, as shown in FIG. 6B, or adapted to be slidably insertable within the interior of a picket 22, if the pickets 22 are tubular. Instead of decorative finials, flat plugs may be secured to the upwardly facing end of each picket 22, or to only select pickets 22. Like the finials 50, the plugs preferably include a lower portion that is adapted to either slidably fit around the outside of a picket 22, or to be slidably insertable within the interior of a tubular picket 22.

Figure 1F:
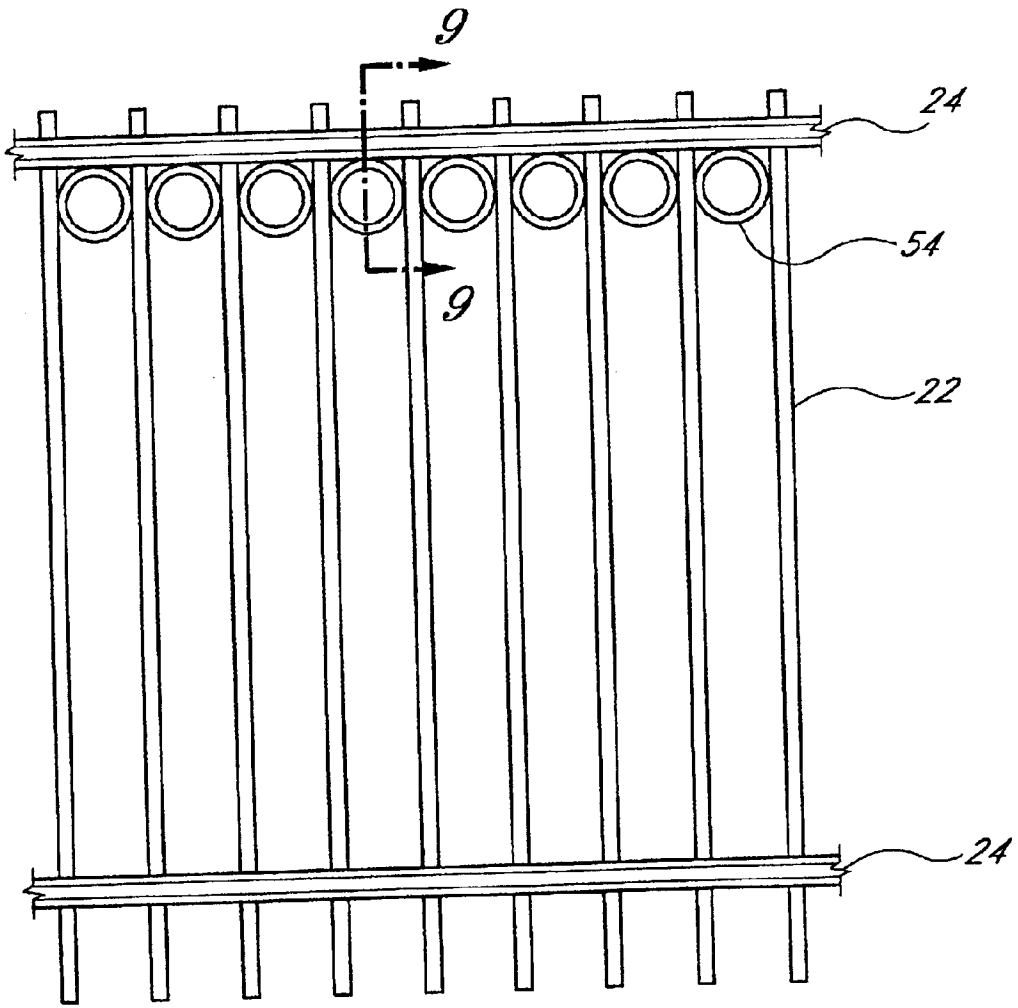
FIG. 1F is a front view of a portion of another embodiment of the assembled picket fence, wherein each picket extends a distance x above the upper surface of the upper rail, and decorative inserts adorn the lower surface of the upper rail.
Figure 8B:
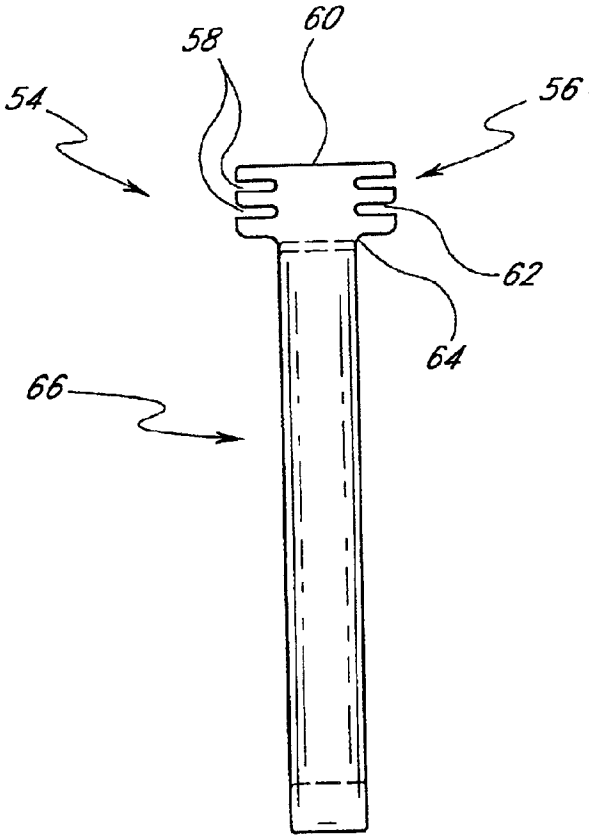
FIG. 8B is a side view of the decorative insert of FIG. 8A.
Figure 8A:
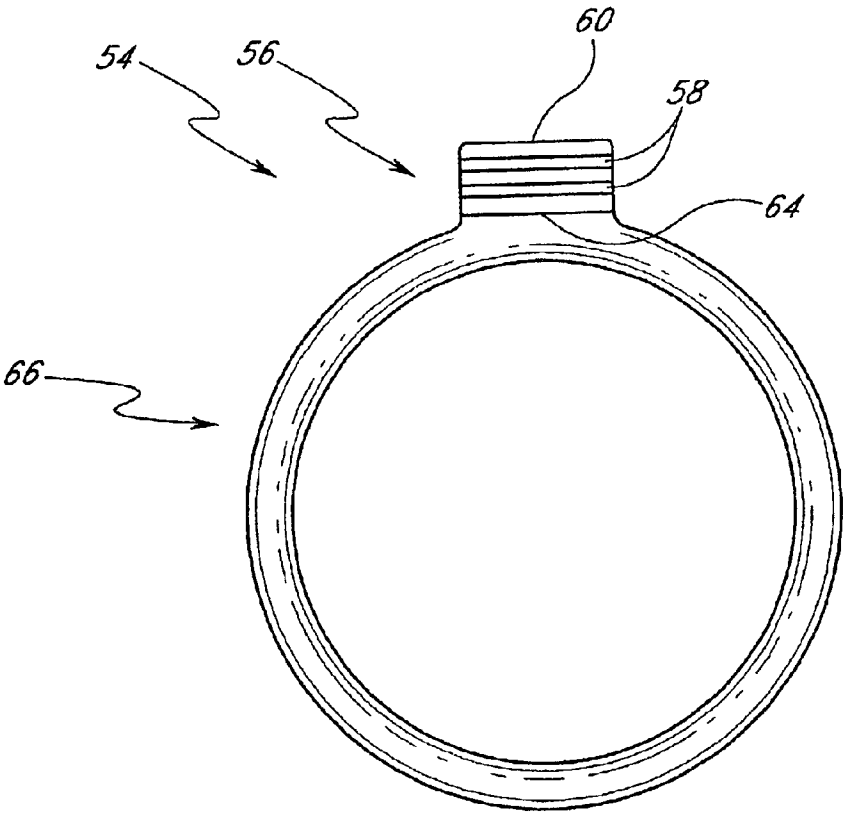
FIG. 8A is a front view of a decorative insert of the picket fence, illustrating a ring design.
Figure 9:
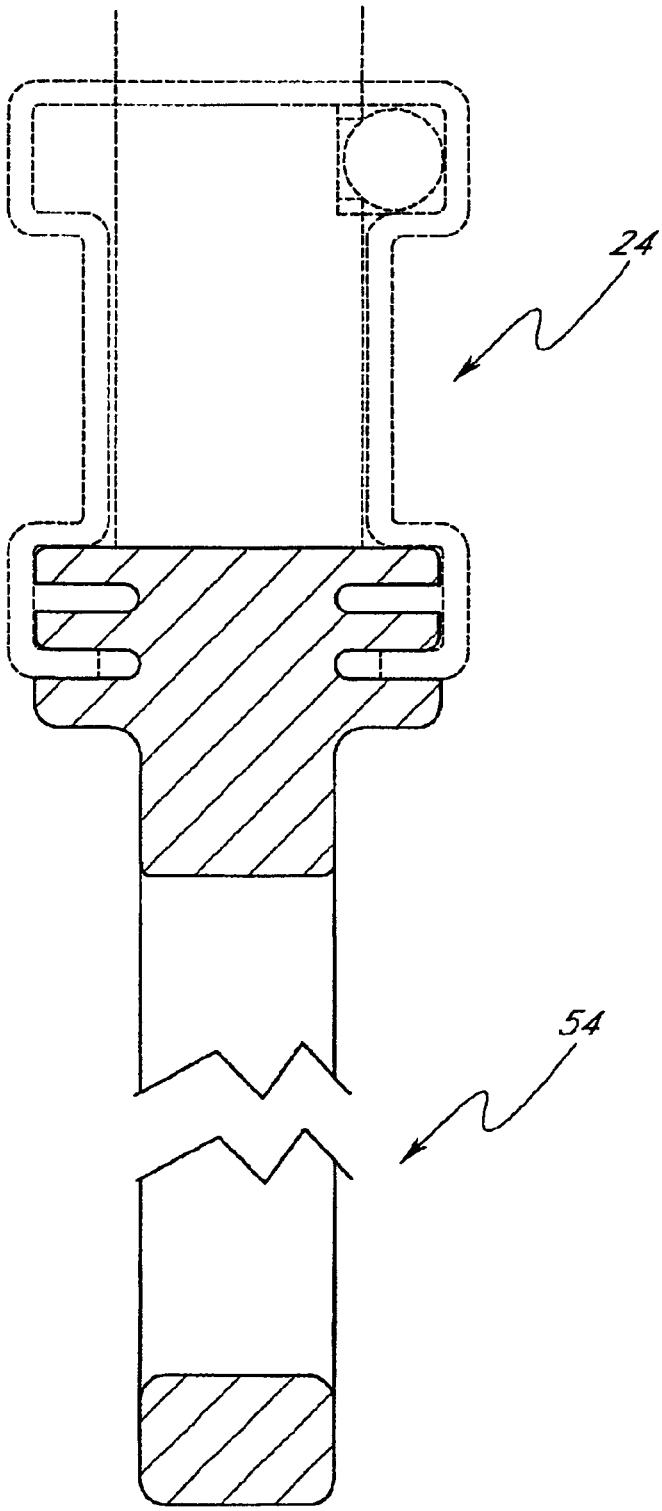
FIG. 9 is a side cross-sectional view of an upper rail and the decorative insert of FIGS. 8A-8B.

With any of the above configurations, decorative inserts 54 may be inserted into the lower slots 38 of the upper and/or lower rail 24, as shown in FIG. 1F. One such insert 54, having a ring configuration, is shown in FIGS. 8A-8B. The insert 54 includes an upper mounting portion 56 in the general shape of a rectangular box, but having at least one groove 58 on opposite sides. The mounting portion 56 is preferably sized to slide easily within the lower slots 38 of the rails 24, as shown in FIG. 9. For proper sizing, the transverse width of the mounting portion 56 is preferably greater than the width of the channel 44, but less than or equal to the distance between the inside faces of the lower slots 38, the transverse distance between the base of oppositely disposed grooves 58 is preferably equal to or less than the width of the channel 44, and the distance between an upper surface 60 of the mounting portion 56 and an upper surface 62 of each groove 58 is preferably less than or equal to the height of the lower slots 38. The mounting portion 56 of the insert 54 may thus be slid within the lower slots 38 with the sides of the channel 44 cooperating with the grooves 58 in the mounting portion 56 to secure the insert 54 to the rail 24.

Attached to a lower surface 64 of the mounting portion 56 is a decorative portion 66. This portion may be of any suitable design as desired. The pictured design is a ring having an outside radius roughly equal to the distance between neighboring pickets 22. The ring may of course be smaller, if desired. One insert 54 may be attached to the rail 24 between each pair of pickets 22, or a smaller number of inserts 54 may be used, such as one insert 54 between every other pair of pickets 22.

Figure 7A:
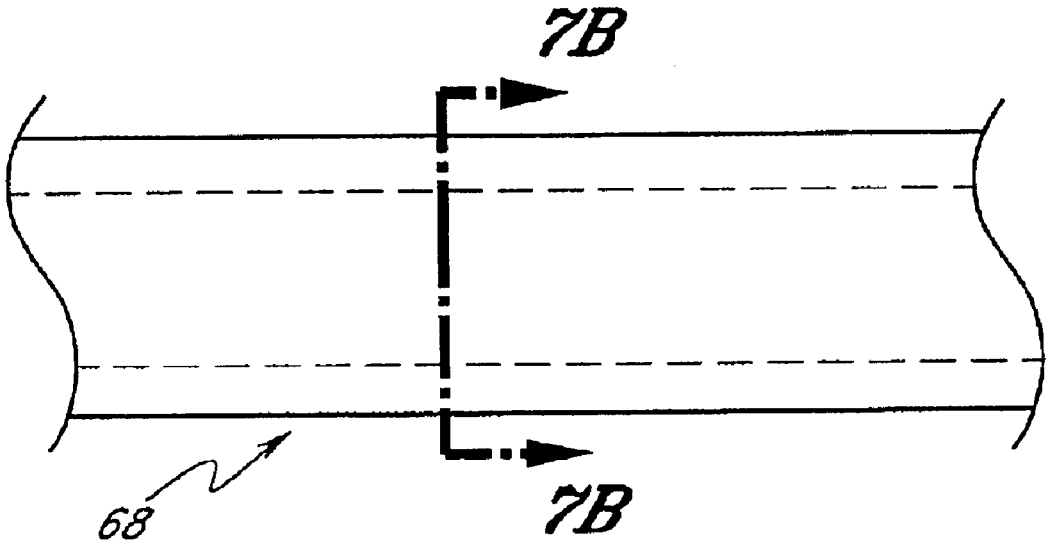
FIG. 7A is a top view of a section of a preferred cap of the picket fence.
Figure 7B:
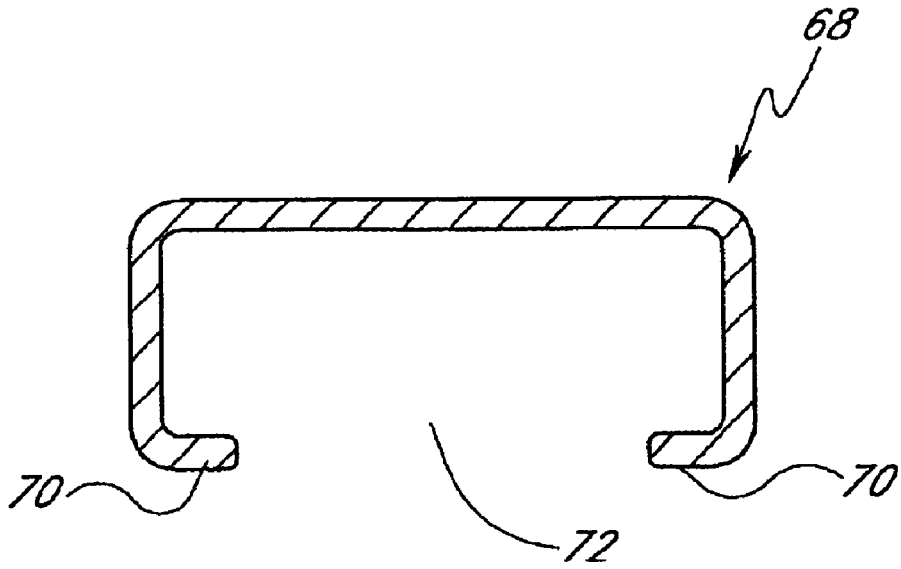
FIG. 7B is a left-side cross-sectional view of the cap of FIG. 7A.

If desired, the fence 20 of the present invention may be configured so that no pickets 22 protrude from the upper rail 24. To produce this configuration, the upper rail 24 is oriented channel-side-up, the lower rail 24 is oriented channel-side-down, and the first end 26 of each picket 22 points upward. As in all previous configurations, the retaining rod 48 is inserted into an upper slot 34 of each rail 24. Note however, that since the upper rail 24 is inverted, the upper slots 34 reside beneath the lower slots 38. Thus, since the height of the rail 24 is preferably greater than the distance d between the picket first end 26 and the first notch 28, no picket 22 protrudes from the lower surface 40 of the upper rail 24. In this configuration, each picket 22 protrudes a distance y from the lower surface 40 of the lower rail 24. With the upper rail 24 inverted, the channel 44 faces upward. To enclose this channel 44 and provide a smooth, continuous upper surface for the fence 20, an elongate cap 68 may fit over the lower portion of the upper rail 24, as shown in FIG. 6C. The cap, illustrated in FIGS. 7A-7B, preferably has a substantially C-shaped cross-section including a pair of flaps 70 disposed about opposite sides of a channel 72. The cap 68 thus snugly fits about the outside of the lower slots 38 in the upper rail 24. For rails having different outside cross-sections, such as those illustrated in FIGS. 2D-2F and others, caps having corresponding shapes may be provided.

In each of the above configurations the retaining rod 48 is disposed within one of the upper slots 34. The rod 48 may also be disposed within one of the lower slots 38, which provides the fence 20 with a further variety of configurations as will be apparent to one skilled in the art.

The above presents a description of the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

What is claimed is:

1. A picket fence and rail mounting system comprising:

at least an upper and a lower, elongate rail in spaced relation to one another, each rail having a hollow interior defining a substantially I-shaped cross-section having a first surface, a second surface, at least a first slot adjacent the first surface, at least a second slot adjacent the second surface, a plurality of spaced openings in the first surface, and a channel in the second surface, the channel having a width that is at least as wide as the width of each opening;

at least one elongate picket having a first end and a second end, at least a first notch or indentation in a picket face, and a cross-sectional shape substantially the same as, but of slightly smaller dimension than the openings in the first surface of the rails; and at least one elongate retaining rod disposed within at least one of the rails, wherein the rod cooperates with the first notch or indentation on each picket to secure the picket to the rail; and wherein the rod is alternately disposable within either of the first or second slots of the upper rail, and alternately disposable within either of the first or second slots of the lower rail, and each rail may be alternately oriented such that the first surface resides above the second surface and vice versa, wherein the rod is disposable in first and second vertically spaced positions respectively defined by the slots of the upper rail to secure the picket in first and second positions corresponding to the first and second positions of the rod.

2. The system of claim 1, wherein each notch comprises a substantially V-shaped upper extent and a substantially V-shaped lower extent such that the vertices of each V are oppositely disposed and define a minimum width of the notch.

3. The system of claim 1, wherein the first notch or indentation is located near the first end and the picket further comprises a second notch or indentation near the second end.

4. The system of claim 3, wherein the notches or indentations on each picket are in one picket face.

5. The system of claim 3, wherein the notches or indentations on each picket are in oppositely facing picket faces.

6. The system of claim 3, wherein a distance between the first picket end and first notch or indentation is shorter than a distance between the second picket end and second notch or indentation.

7. The system of claim 6, wherein with both the upper and lower rails oriented such that the first surface of each faces upward, and each picket oriented such that the first end of each faces upward and the second end of each faces downward, and the retaining rod residing within the first rail slot in the upper rail such that the rod cooperates with the first notch or indentation on each picket, the first end of each picket extends upwardly a distance x from the first surface of the upper rail and the second end of each picket extends downwardly a distance y from the second surface of the lower rail, wherein y is greater than x.

8. The system of claim 6, wherein with both the upper and lower rails oriented such that the first surface of each faces upward, and each picket oriented such that the second end of each faces upward and the first end of each faces downward, and retaining rod residing within the first rail slot in the upper rail such that the rod cooperates with the second notch or indentation on each picket, the second end of each picket extends upwardly a distance y from the first surface of the upper rail and the first end of each picket extends downwardly a distance x from the second surface of the lower rail, wherein y is greater than x.

9. The system of claim 6, wherein with both the upper and lower rails oriented such that the first surface of each faces upward, and a first set of pickets oriented such that the first end of each faces upward and the second end of each faces downward, and a second set of pickets oriented such that the second end of each faces upward and the first end of each faces downward, and a retaining rod residing within the first rail slot in the upper rail such that the rod cooperates with the first notch or indentation of each picket in the first set and the second notch or indentation of each picket in the second set, the first end of each picket in the first set extends upwardly a distance x from the first surface of the upper rail and the second end of each picket in the first set extends downwardly a distance y from the second surface of the lower rail, and the second end of each picket in the second set extends upwardly a distance y from the first surface of the upper rail and the first end of each picket in the second set extends downwardly a distance x from the second surface of the lower rail, wherein y is greater than x.

10. The system of claim 7, 8 or 9, further comprising decorative finials, wherein each finial comprises a lower portion configured to slidably engage one end of a picket, and an upper portion configured to provide an aesthetic design.

11. The system of claim 7, 8 or 9, further comprising decorative inserts, wherein each insert comprises a mounting portion configured to slidably engage the lower slots of at least the upper or lower rail, and an decorative portion configured to provide an aesthetic design.

12. The system of claim 6, wherein with the upper rail oriented such that its first surface faces downward, and the lower rail oriented such that its first surface faces upward, and each picket oriented such that the first end of each faces upward and the second end of each faces downward, and the retaining rod residing within the first rail slot in the upper rail such that the rod cooperates with the first notch or indentation on each picket, the first end of each picket is flush with or beneath the second surface of the upper rail and the second end of each picket extends downwardly a distance y from the second surface of the lower rail.

13. The system of claim 12, further comprising an elongate cap having a substantially C-shaped cross-section and configured to slidably engage the second surface of the upper rail and provide a continuous flat cover therefor.

14. The system of claim 1, wherein an exterior surface of each rail defines a substantially I-shaped cross-section.

15. The system of claim 1, wherein the pickets are tubular.

16. The system of claim 1, wherein the rod is cylindrical.

17. The system of claim 1, wherein the rod has an oval cross-section.

18. The system of claim 1, wherein the rod has a flattened-oval cross-section.

19. The system of claim 1, wherein the rod has a square cross-section.

20. The system of claim 1, wherein the rod has an L-shaped cross-section.

21. A picket fence and rail mounting system comprising:

at least an upper and a lower elongate rail in spaced relation to one another, each rail having a hollow interior defining a substantially L-shaped cross-section having a first surface, a second surface vertically spaced from the first surface, at least a first slot adjacent the first surface, at least a second slot adjacent the second surface, the first and second slots being vertically spaced, a plurality of spaced openings in the first surface, and a channel in the second surface, the channel having a width that is at least as wide as the width of each opening;

at least one elongate picket having a first end and a second end, at least a first hole in a picket face, and a cross-sectional shape substantially the same as, but of slightly smaller dimension than the openings in the first surface of the rails; and at least one fastening member cooperating with the at least one hole to secure the picket to the rail, wherein each rail may be alternately oriented such that the first surface faces upward and such that the first surface faces downward.

22. The system of claim 21, wherein the at least one fastening member comprises a spring clip.

23. The system of claim 22, wherein the spring clip may be inserted within the first slot or the second slot of the upper rail, and the spring clip may be inserted within the first slot or the second slot of the lower rail.

24. The system of claim 21, wherein the at least one fastening member comprises a threaded screw.

25. A picket fence and rail mounting system comprising:

an elongate, substantially hollow rail having a top wall with a plurality of spaced openings, and a bottom wall with an elongate channel having a width that is at least as wide as the width of each opening, the rail having a first interior width at a vertical center thereof, the first interior width being measured in a horizontal direction from a first inside surface thereof to a second inside surface thereof, and a second interior width at a height just beneath the top wall, the second interior width being measured in a horizontal direction from the first inside surface to the second inside surface, the second interior width being greater than the first interior width, thus defining an interior elongate slot adjacent the top wall;

at least one elongate picket with a notch or indentation in a side of the picket, and a cross-sectional shape sized to fit snugly within one of the openings and the channel; and an elongate retaining rod disposed within the slot and the notch or indentation to secure the picket to the rail.

26. The system of claim 25, wherein the rail may be alternately oriented such that the top wall faces upward or the channel faces upward.

27. The system of claim 25, wherein the picket notch or indentation is a first picket notch or indentation located near a first picket end, and the picket further comprises a second notch or indentation near a second picket end.

28. The system of claim 27, wherein a distance between the first picket end and first notch or indentation is shorter than a distance between the second picket end and second notch or indentation.

29. A picket fence and rail mounting system comprising:

at least an upper and a lower elongate rail in spaced relation to one another, each rail having a hollow interior defining an I-shaped cross-section having a first surface, a second surface, at least a first slot adjacent the first surface, at least a second slot adjacent the second surface, a plurality of spaced openings in the first surface, and a channel in the second surface, the channel having a width that is at least as wide as the width of each opening;

at least one elongate picket having a first end and a second end, at least a first notch or indentation in a picket face, and a cross-sectional shape substantially the same as, but of slightly smaller dimension than the openings in the first surface of the rails; and at least one elongate retaining rod disposed within at least one of the rails, wherein the rod cooperates with a notch or indentation on each picket to secure the picket to the rail; and wherein the rod is disposable in first and second vertically spaced positions respectively defined by the slots of the upper rail to secure the picket in first and second positions corresponding to the first and second positions of the rod.

30. The system of claim 29, wherein each notch comprises a substantially V-shaped upper extent and a substantially V-shaped lower extent such that the vertices of each V are oppositely disposed and define a minimum width of the notch.

31. The system of claim 29, the first notch or indentation is located near the first end and the picket further comprises a second notch or indentation near the second end.

32. The system of claim 31, wherein the notches or indentations on each picket are in one picket face.

33. The system of claim 31, wherein the notches or indentations on each picket are in oppositely facing picket faces.

34. The system of claim 31, wherein a distance between the first picket end and first notch or indentation is shorter than a distance between the second picket end and second notch or indentation.

35. The system of claim 34, wherein with both the upper and lower rails oriented such that the first surface of each faces upward, and each picket oriented such that the first end of each faces upward and the second end of each faces downward, and the retaining rod residing within the first rail slot in the upper rail such that the rod cooperates with the first notch or indentation on each picket, the first end of each picket extends upwardly a distance x from the first surface of the upper rail and the second end of each picket extends downwardly a distance y from the second surface of the lower rail, wherein y is greater than x.

36. The system of claim 34, wherein with both the upper and lower rails oriented such that the first surface of each faces upward, and each picket oriented such that the second end of each faces upward and the first end of each faces downward, and retaining rod residing within the first rail slot in the upper rail such that the rod cooperates with the second notch or indentation on each picket, the second end of each picket extends upwardly a distance y from the first surface of the upper rail and the first end of each picket extends downwardly a distance x from the second surface of the lower rail, wherein y is greater than x.

37. The system of claim 34, wherein with both the upper and lower rails oriented such that the first surface of each faces upward, and a first set of pickets oriented such that the first end of each faces upward and the second end of each faces downward, and a second set of pickets oriented such that the second end of each faces upward and the first end of each faces downward, and a retaining rod residing within the first rail slot in the upper rail such that the rod cooperates with the first notch or indentation of each picket in the first set and the second notch or indentation of each picket in the second set, the first end of each picket in the first set extends upwardly a distance x from the first surface of the upper rail and the second end of each picket in the first set extends downwardly a distance y from the second surface of the lower rail, and the second end of each picket in the second set extends upwardly a distance y from the first surface of the upper rail and the first end of each picket in the second set extends downwardly a distance x from the second surface of the lower rail, wherein y is greater than x.

* * * * *

UNITED STATES PATENT AND TRADEMARK OFFICE

CERTIFICATE OF CORRECTION

PATENT NO. : 6,824,123 B2
DATED : November 30, 2004
INVENTOR(S) : Charles Larsen et al.

It is certified that error appears in the above-identified patent and that said Letters Patent is hereby corrected as shown below:

Column 13,
Line 15, replace "L-shaped" with -- I-shaped --

Signed and Sealed this

Twenty-eighth Day of June, 2005

JON W. DUDAS
*Director of the United States Patent and Trademark Office*